US005972588A

United States Patent [19]

Nabeta

[11] Patent Number: 5,972,588

[45] Date of Patent: Oct. 26, 1999

[54] SILVER HALIDE PHOTOGRAPHIC EMULSION AND METHOD FOR PRODUCING THE SAME

[75] Inventor: Toshiyuki Nabeta, Minami-ashigara, Japan

[73] Assignee: Fuji Photo Film Co., Ltd., Kanagawa, Japan

[21] Appl. No.: 08/779,081

[22] Filed: Jan. 8, 1997

[30] Foreign Application Priority Data

Jan. 8, 1996 [JP] Japan ..... 8-018122

[51] Int. Cl.[6] ..... G03C 1/035; G03C 1/08

[52] U.S. Cl. ..... 430/567; 430/569; 430/603; 430/605; 430/599

[58] Field of Search ..... 430/567, 569, 430/603, 605, 599

[56] References Cited

U.S. PATENT DOCUMENTS

| | | | |
|---|---|---|---|
| 4,386,156 | 5/1983 | Mignot | 430/567 |
| 5,292,632 | 3/1994 | Maskasky | 430/567 |
| 5,314,798 | 5/1994 | Brust et al. | 430/567 |
| 5,356,764 | 10/1994 | Szajewski et al. | 430/567 |
| 5,565,314 | 10/1996 | Nakatsu et al. | 430/567 |
| 5,565,315 | 10/1996 | Yamashita | 430/567 |
| 5,593,821 | 1/1997 | Oyamada | 430/567 |
| 5,637,446 | 6/1997 | Yamashita | 430/567 |
| 5,665,530 | 9/1997 | Oyamada et al. | 430/567 |

FOREIGN PATENT DOCUMENTS 0 584 644 A2 3/1994 European Pat. Off. ..... G03C 1/005

OTHER PUBLICATIONS

A. Mignot et al., Journal of Crystal Growth, pp. 207–213, Vo. 23, No. 3., Sep. (1974).

*Primary Examiner*—Mark F. Huff
*Attorney, Agent, or Firm*—Birch, Stewart Kolasch & Birch, LLP

[57] ABSTRACT

There is disclosed a silver halide photographic emulsion, which comprises silver halide tabular grains that have {100} planes as principal planes and have the following features, the emulsion being subjected to chemical sensitization: (a) 50% or more of the projected areas of the tabular grains is attributed to tabular grains having an aspect ratio of 2 or more, (b) each of the tabular grains has a mixed crystal region containing, in addition to main halide ions, different halide ions in an amount of 0.01 mol % or more, but 25 mol % or less, in the nucleus part and/or in part of the growth part or in the whole of the grown part, and (c) when the principal planes of the tabular grains are observed using a transmission-type electron microscope, one or more, but ten or less, dislocation lines are observed on the principal planes of each grain of 50% or more of the tabular grains. The photographic emulsion, in which dislocation is fixed in grains even after the growth and post-ripening processes, is high in aspect ratio and monodispersibility of grains.

20 Claims, 2 Drawing Sheets

SILVER HALIDE PHOTOGRAPHIC EMULSION AND METHOD FOR PRODUCING THE SAME

FIELD OF THE INVENTION

The present invention relates to a silver halide photographic light-sensitive material, and more particularly to a method of making a silver halide color photographic light-sensitive material that is excellent in rapid processibility, and that exhibits photographic characteristics high in sensitivity and excellent in graininess and process stability; and further the present invention relates to a process for manufacturing a silver halide photographic light-sensitive emulsion.

BACKGROUND OF THE INVENTION

Presently, commercially available silver halide color photographic light-sensitive materials, and methods for forming an image using them, diversify variously and are used in various fields.

For the purpose of attaining high sensitivity, the halogen composition of the silver halide emulsions used in these many light-sensitive materials is usually silver iodobromide or silver chloroiodobromide, mainly made up of silver bromide in many cases, and it has now become a trend that tabular silver halide grains that have various merits because of their shape are used.

On the other hand, the demand for rapid processing for color photographic light-sensitive materials has increased more and more in recent years, and to meet the demand it is required to provide a silver halide color photographic light-sensitive material whose silver halide emulsion is made up mainly of silver chloride.

As a known technique in which a silver halide emulsion is made up mainly of silver chloride, silver chloride tabular grains whose principal planes are {100} planes are disclosed, for example, in JP-A ("JP-A" means unexamined published Japanese patent application) No. 204073/1993. When these grains are used in silver halide color photographic light-sensitive materials, they are expected to be excellent in rapid processibility and advantageous in the attainment of high sensitivity. The mechanism of anisotropic growth of these tabular grains having {100} planes is disclosed in the Journal of Crystal Growth 23 (1974) 207–213 and JP-A No. 59360/1994, which suggest that they are caused by dislocation present in the grains. However, since, up to the present, no report has been made in which the dislocation is observed after post-ripening, it seems that this dislocation disappears during growth of the {100} tabular grain formation or during post-ripening. Thus, it is the present state of the art that the graininess and photographic properties of tabular grains when the dislocation is purposely made to be present in the grains after the growth process and after completion of the post-ripening process, are not known at all up to the present.

SUMMARY OF THE INVENTION

An object of the present invention is to fix intentionally the dislocation in tabular grains by causing part or the whole of each of the tabular grains to become a mixed crystal region containing 0.01 mol % or more of different kind of halide ions, to thereby allow the dislocation to remain in the grains even in the growth process and the post-ripening process. By attaining this, it is possible to prevent the dislocation, which is considered to be the driving force for anisotropic growth in the production of {100} tabular grains, from disappearing, to manufacture monodisperse tabular grains having a high aspect ratio. Further, according to the present invention, an increase in sensitivity, due to the dislocation, which has been allowed intentionally to remain in the final tabular grains after post-ripening, can be expected.

Thus, the present invention, in which part or the whole of each of tabular grains is formed into a mixed crystal, to fix the dislocation, is expected to contribute greatly to the progress of color photographic light-sensitive materials.

Other and further objects, features, and advantages of the invention will appear more apparent from the following description, taken in connection with the accompanying drawings.

DETAILED DESCRIPTION OF THE INVENTION

Figure 1:
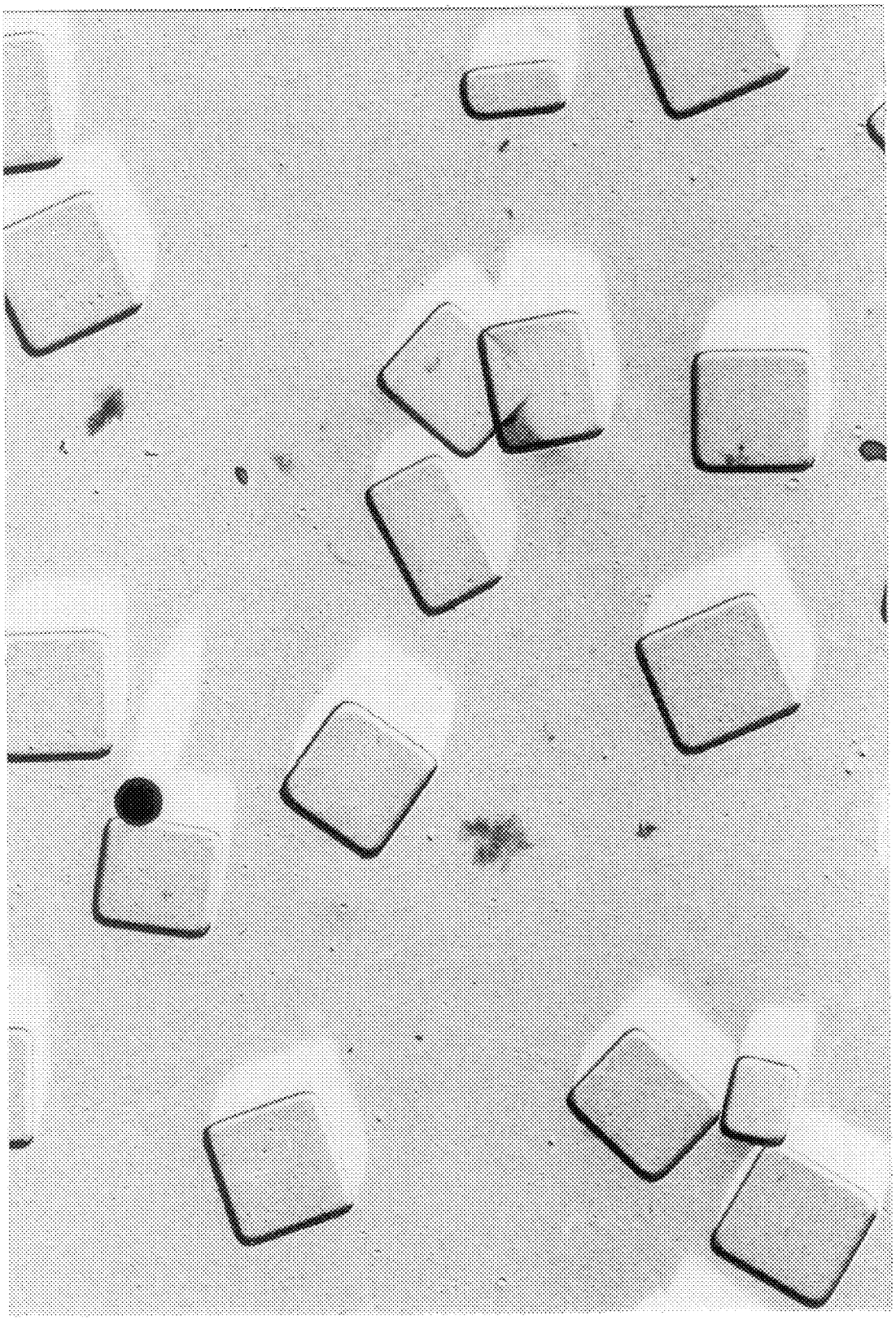
FIG. 1 is a photomicrography with a shadow of a carbon particle replica, showing the crystal structure of grains of Emulsion (F) of the present invention.

The object of the present invention has been attained by the following items:

(1) A silver halide photographic emulsion, which comprises silver halide tabular grains that have {100} planes as principal planes and have the following features, the emulsion being subjected to chemical sensitization:

(a) 50% or more of the projected areas of the tabular grains is attributed to tabular grains having an aspect ratio of 2 or more, (b) each of the tabular grains has a mixed crystal region containing, in addition to main halide ions, different halide ions in an amount of 0.01 mol % or more, but 25 mol % or less, in the nucleus part and/or in part of the growth part or in the whole of the grown part, and (c) when the principal planes of the tabular grains are observed using a transmission-type electron microscope, one or more, but ten or less, dislocation lines are observed on the principal planes of each grain of 50% or more of the tabular grains.

(2) The silver halide photographic emulsion as stated in the above (1), wherein the said main halide ions are chloride ions.

(3) The silver halide photographic emulsion as stated in the above (2), wherein the said different halide ions are bromide ions.

(4) The silver halide photographic emulsion as stated in the above (2), wherein the said different halide ions are iodide ions.

(5) The silver halide photographic emulsion as stated in the above (1), wherein the said main halide ions are bromide ions.

(6) The silver halide photographic emulsion as stated in the above (5), wherein the said different halide ions are chloride ions.

(7) The silver halide photographic emulsion as stated in the above (5), wherein the said different halide ions are iodide ions.

(8) The silver halide photographic emulsion as stated in the above (1), wherein, when the principal planes of the said tabular grains are observed using a transmission-type electron microscope, one end of a dislocation line is observed in each of two adjacent sides of the quadrangle that is the principal plane of each grain, in 40% or more of the tabular grains.

(9) The silver halide photographic emulsion as stated in the above (8), wherein, when the principal planes of the said tabular grains are observed using a transmission-type electron microscope, one or two dislocation lines, starting from one corner of the quadrangle that is the principal plane, are observed in 15% or more of the tabular grains.

(10) The silver halide photographic emulsion as stated in the above (8), wherein, when the principal planes of the said tabular grains are observed using a transmission-type electron microscope, one or two dislocation lines, not starting from any corner of the quadrangle that is the principal plane, are observed in 15% or more of the tabular grains.

(11) The silver halide photographic emulsion as stated in the above (1), wherein, when the principal planes of the said tabular grains are observed using a transmission-type electron microscope, one dislocation line, starting from one corner of the quadrangle that is the principal plane, is observed in 1% or more, but 40% or less, of the tabular grains.

(12) The silver halide photographic emulsion as stated in the above (1), wherein the deviation coefficient (standard deviation/average diameter) of the diameter distribution of the said tabular grains is from 0 to 0.35, and wherein the side ratio (the longer side of the quadrangle that is the principal plane/the shorter side) is from 1 to 2.

(13) A method for producing the silver halide photographic emulsion in the above (2), comprising introducing silver ions and halide ions, as well as a dispersion medium, into a continuous double jet reaction vessel, forming nuclei of tabular grains in the presence of a bromide, together with the chloride that constitutes the main halide ions and is present in the dispersion medium, and permitting further 0.5 to 15 mol % of a bromide to be present in the reaction vessel during the growth of the grains.

(14) A method for producing the silver halide photographic emulsion in the above (2), comprising introducing silver ions and halide ions, as well as a dispersion medium, into a continuous double jet reaction vessel, forming nuclei of tabular grains in the presence of a bromide, together with the chloride that constitutes the main halide ions and is present in the dispersion medium, and permitting further 0.001 to 1 mol % of an iodide to be present in the reaction vessel during the growth of the grains.

(15) A method for producing the silver halide photographic emulsion in the above (2), comprising introducing silver ions and halide ions, as well as a dispersion medium, into a continuous double jet reaction vessel, and forming nuclei of tabular grains in the presence of 2.5 mol % or more of a bromide, together with the chloride that constitutes the main halide ions and is present in the dispersion medium.

The tabular silver halide emulsion having mixed crystals grown of the present invention will be described below.

Herein, "tabular grains" means grains whose value obtained by dividing the circle-equivalent diameter (a diameter of a circle corresponding to the projected area of the tabular grain, when the projected area is assumed to be a circle) of the principal plane of the tabular grains by the thickness (hereinafter the value being referred to as an aspect ratio), is more than 1. Herein, "principal planes" are defined as a set of parallel planes having the largest area among the crystal surface planes that form an emulsion grain being substantially a rectangular parallelopiped. Whether the principal planes are {100} planes or not can be examined by electron diffractometry or X-ray diffractometry. Substantially rectangular parallelopiped emulsion grains are composed of grains whose principal planes are {100} planes, and the grains can have 1 to 8 {111} crystal planes. That is, one to eight of the eight corners of the rectangular parallelopiped may be chamfered.

Further, the aspect ratio of the tabular grains is 2 or more, preferably 4 or more, and the upper limit of the aspect ratio is preferably 25 or less, and further preferably the aspect ratio is from 4 to 20. The thickness of the tabular grains is preferably 0.5 $\mu$m or less, more preferably 0.03 to 0.3 $\mu$m, and further preferably 0.05 to 0.2 $\mu$m.

Further, the tabular grains account for 50% or more, preferably 70% or more, and more preferably 80% or more, of the total projected area. Herein "projected area" means the projected area obtained when the silver halide emulsion grains are placed on a substrate with them not overlapping each other, and with the principal planes of the tabular grains in parallel with the substrate surface.

Further, the {100} mixed crystal tabular grains for use in the present invention are characterized in that the dislocation lines introduced during the formation of the nuclei do not disappear. Generally, it is observed that, in {100} tabular grains, dislocation lines introduced during the formation of the nuclei disappear, during the formation of the grains, for example, during physical ripening, or during growth of the grains, whereby the grains are made thick. The present invention is characterized in that the introduced dislocation lines are subjected to pinning, so that the dislocation lines will exist stably in part of or throughout the physical ripening process or the growth process. Herein, "pinning" means a mechanism (a process) for hindering the movement (shift) of dislocation lines.

In the present invention, a different halide, which will be an impurity in crystals and will cause pinning, is mixed into each of the nucleus parts and/or part or all of each of the grown parts, to suppress the disappearing of the dislocation lines. Herein, by "nucleus parts" is meant monodisperse grains obtained after the nucleus formation/ripening process in a series of grain formation processes (the nucleus formation/ripening/growth). Further, herein, by "grown parts" is meant grown parts obtained by growing those nucleus parts using the ion addition method or the fine particle addition method. Further, herein, "part of the grown part" means a grown section that preferably accounts for 20% or more but 100% or less, more preferably 40% or more but 100% or less, and further preferably 60% or more but 100% or less, of the amount of the silver at the grown site.

Preferably, the mixed crystal region is introduced in the early stage of ripening or in the early stage of growth, in which stage dislocation in grains hardly disappears. Herein, "the early stage of growth" means the stage in which, assuming the amount of all the grown silver to be 100 mol %, preferably 50 mol % or less of silver, more preferably 40 mol % or less of silver, and further preferably 30 mol % or less of silver, has been consumed from the start of the growth.

The pinned dislocation lines can be observed directly from a TEM image in the direction vertical to the principal plane of the tabular grain. The dislocation lines are kept in preferably 50% or more, more preferably 70% or more, and particularly preferably 80% or more, of the tabular grains after the growth and/or post-ripening. The present invention covers grains whose dislocation lines extend directly from the nucleus at the time of the formation of the nucleus, or grains whose dislocation lines extended have partially disappeared.

The dislocation lines observed on the principal planes of the tabular grains, when the principal planes of the tabular grains are observed under a transmission-type electron microscope, are characterized in that they exist on the principal planes all the time from the ripening through the growth and after post-ripening. The number of dislocation lines is preferably 1 or more, but 10 or less, more preferably 1 or more, but 7 or less, and further preferably 1 or more, but 5 or less.

In the present invention, both {100} tabular grains whose main halide is a chloride, and {100} tabular grains whose main halide is a bromide, can be used.

When the main halide of the tabular grains is a chloride, preferably the chloride contained in the tabular grains amounts to 50 mol % or more, more preferably 70 mol % or more, and particularly preferably 80 mol % or more, of the halogen composition in the grains.

When the main halide of the tabular grains is a chloride, preferably a different halide, a bromide, amounts to 0.5 to 15 mol %, more preferably 1 to 10 mol %, and particularly preferably 2.5 to 7 mol %, of the halogen composition in the grains.

When the main halide of the tabular grains is a chloride, preferably a different halide, an iodide, amounts to 0.001 to 1 mol %, more preferably 0.001 to 0.1 mol %, of the halogen composition in the grains.

When the main halide of the tabular grains is a bromide, preferably the bromide contained in the tabular grains amounts to 50 mol % or more, more preferably 70 mol % or more, and particularly preferably 80 mol % or more, of the halogen composition in the grains.

When the main halide of the tabular grains is a bromide, preferably a different halide, a chloride, amounts to 1 to 25 mol %, more preferably 5 to 20 mol %, of the halogen composition in the grains.

When the main halide of the tabular grains is a bromide, preferably a different halide, an iodide, amounts to 0.001 to 1 mol %, more preferably 0.001 to 0.1 mol %, of the halogen composition in the grains.

Further, these different halide ions can be simultaneously contained in {100} tabular grains whose main halide is a chloride, and {100} tabular grains whose main halide is a bromide, respectively, in the range in which the above described halogen composition is satisfied.

Preferably tabular grains characterized in that one end of a dislocation line is observed in each of the two adjacent sides of the quadrangle that is the principal plane, amount to 40% or more, more preferably 60% or more, and particularly preferably 80% or more, of all the tabular grains.

Further, preferably, tabular grains (A) characterized in that one end of a dislocation line is observed in each of the two adjacent sides of the quadrangle that is the principal plane, and one or two dislocation lines starting from only one corner not adjacent to the said two sides are observed, amount to 15% or more, more preferably 30% or more, and particularly preferably 45% or more, of all the tabular grains.

Further, preferably, tabular grains (B) characterized in that one end of a dislocation line is observed in each of the two adjacent sides of the quadrangle that is the principal plane, and a dislocation line starting not from any corner of the quadrangle that is the principal plane is observed, amount to 15% or more, more preferably 30% or more, and particularly preferably 45% or more, of all the tabular grains.

Further, if the tabular grains (A) amount only to 35% or less of all the tabular grains, preferably the tabular grains (B) amount to 30% or more, more preferably 40% or more, and particularly preferably 50% or more, of all the tabular grains.

Further, preferably tabular grains characterized in that one dislocation line starting from one corner of the quadrangle that is the principal plane is observed, amount to 1% or more, but 40% or less, more preferably 1% or more, but 20% or less, of all the tabular grains.

When there are two dislocation lines starting from one corner of the quadrangle that is the principal plane, it is characteristic that the angle between them observed in the direction vertical to the principal plane is generally 5° or more, but 85° or less, preferably 30° or more, but 75° or less, and more preferably 45° or more, but 75° or less. Further, it is characteristic that, in many cases, dislocation lines are introduced in the (31n) direction, assuming the side plane of the tabular grain to be {100}.

Further, these dislocation lines can be similarly observed after post-ripening, in the range that satisfies the above characteristics of the dislocation lines.

By fixing dislocation having these characteristics, the present invention has made possible the formation of tabular grains excellent in monodispersibility and regulated in the shape of principal planes. On the other hand, if the present invention is applied to {100} tabular grains having dislocation lines not having these characteristics, although the thickness of the tabular grains decreases a little, the dispersibility and the side ratio are apt to become deteriorated.

The monodispersibility and the side ratio in the tabular grains for use in the present invention will be described in detail. Preferably the deviation coefficient of the diameter distribution (standard deviation/average diameter) of the tabular grains is 0 to 0.35, more preferably 0 to 0.3, further preferably 0 to 0.25, and most preferably 0 to 0.2, and preferably the side ratio (the longer side of the quadrangle of the principal plane/the shorter side) is from 1 to 2, more preferably from 1 to 1.5, and further preferably from 1 to 1.25. Herein "diameter" means the diameter of a circle whose area is equal to the projected area of the grain. Herein "the longer side and the shorter side of the quadrangle of the principal plane" means the longest side and the shortest side out of the four sides of the right-angled parallelogram forming the shape of the principal plane.

In the present invention, when the main halide is a chloride, silver ions and halide ions, as well as a dispersion medium, are introduced into a continuous double jet reaction vessel, the formation of nuclei of tabular grains is carried out in the presence of a bromide, together with the chloride present in the dispersion medium, and preferably 0.5 to 15 mol %, more preferably 2.5 to 10 mol %, of a bromide is allowed to be present in the reaction vessel during the growth of grains.

In the present invention, when the main halide is a chloride, silver ions and halide ions, as well as a dispersion medium, are introduced into a continuous double jet reaction vessel, the formation of nuclei of tabular grains is carried out in the presence of a bromide, together with the chloride present in the dispersion medium, and preferably 0.001 to 1 mol %, more preferably 0.01 to 0.1 mol %, of an iodide is allowed to be present in the reaction vessel during the growth of grains.

In the present invention, when the main halide is a chloride, silver ions and halide ions, as well as a dispersion medium, are introduced into a continuous double jet reaction vessel, and the formation of nuclei of tabular grains can be carried out, together with the chloride present in the dispersion medium, in the presence of a bromide, preferably in an amount of 2.5 to 10 mol %, more preferably 2.5 to 7 mol %.

The mixed crystal tabular grains according to the present invention can be prepared in the following manner. In passing, although the following is divided roughly into three processes, in some cases a growth process is involved in (1) the nucleus formation process and/or (2) the ripening process.

(1) Nucleus Formation Process

In a dispersion medium solution having at least a dispersion medium and water, first, $Ag^+$ and a single halide ($X_1^-$) or a mixed halide ($X_1'^-$) are reacted with stirring, to form host silver halide nuclei $AgX_1$ or $AgX_1'$ nuclei. Then, a different $X_2^-$ solution or an impurity (e.g. yellow prussiate of potash) is added, to form, substantially, dislocation that will cause the formation of tabular grains. To form that dislocation, the reaction condition is required to have an atmosphere for the formation of {100} planes. Further, since the process for forming the dislocation takes a certain period of time (preferably 3 min or more), it is required that the mixture is kept as it is without adding anything after the addition of the different $X_2^-$ solution or the impurity.

The temperature at which nuclei are formed is preferably 20 to 80° C., more preferably 25 to 50° C. If it is necessary to make the nuclei small, low-temperature growth is preferred. Since a certain amount of energy is required in the process for the formation of dislocation, it is possible to use different temperatures for each of the nucleus formation process and the dislocation formation process.

In the dislocation formation process, by using, for example, a halogen gap or an impurity, dislocation is introduced into the grains. As a specific dislocation introduction and control method, a method wherein the halogen species of a different $X_2^-$, and the amount thereof, and the species of an impurity, and the amount thereof, are optimized is most effective, and thereafter a sufficient period is allowed to pass to achieve a state of equilibrium, or, preferably after the formation of the nuclei, $AgX_1$ or $AgX_1'$ is added for the growth, to bring the effect of the different halide or the impurity to nil as much as possible.

(2) Ripening Process

It is difficult to form tabular grain nuclei only at the time of the formation of nuclei. Therefore, in the subsequent ripening process, grains other than tabular grains are caused to disappear by Ostwald ripening. Preferably the temperature is 10° C. or more higher than the temperature of the nucleus formation, more preferably 50 to 90° C. By the ripening, nuclei of non-tabular grains disappear and deposit on the tabular grains. Preferably, fine grains having compositions and sizes that make them more soluble than the tabular grains are present in the early stage of the ripening, so that the tabular grains will hardly disappear in the early stage of the ripening. Desirably, new introduction of dislocation does not take place during the ripening, and for that purpose, preferably, after the addition of a different halide or an impurity, a sufficient period of time is allowed to pass to achieve a state of equilibrium, or, $AgX_1$ or $AgX_1'$ is added for the growth, to bring the effect of the different halide or the impurity to nil as much as possible.

(3) Growth Process

Thus, each of the tabular grains formed through the nucleus formation/ripening process is formed with a grown part layered on the tabular grains in the subsequent crystal grown process, or it is formed with a grown part layered, after the tabular grains are grown to a desired size. In this case, 1) an ion addition method, wherein a low-supersaturated $Ag^+$ salt solution and a low-supersaturated $X^-$ salt solution are added for the growth; 2) a fine-grain addition method, wherein AgX fine grains are previously formed and are added for the growth; and 3) a combination of these methods, can be mentioned.

1) Ion Addition Method

In the ion addition method, by the C.D.J. method (controlled double jet method), an $Ag^+$ salt solution and an $X^-$ salt solution are mixed and added simultaneously at such addition rates that new nuclei are not substantially formed, with the electrical potential in the mixed solution kept constant. Herein, "substantially" means that the projected area ratio of new nuclei is preferably 10% or less, more preferably 1% or less, and further preferably 0.1% or less.

2) Fine-Grain Addition Method

In the fine-grain emulsion addition method, a silver halide fine-grain emulsion having a diameter of generally 0.15 μm or less, preferably 0.1 μm or less, and more preferably 0.06 μm or less, is added to grow the tabular grains by Ostwald ripening. The fine-grain emulsion can be continuously added or intermittently added. The fine-grain emulsion can be prepared continuously in a mixer provided near the reaction vessel, by feeding an aqueous silver salt solution and an aqueous halide salt solution, and the emulsion can be immediately added continuously into the reaction vessel; or the fine-grain emulsion can be prepared batchwise in a separate container previously, and added continuously or intermittently. Preferably, the fine grains are substantially free from twinned crystal grains. Herein, "substantially free from" means that the number ratio of twinned crystal grains is generally 5% or less, preferably 1% or less, and more preferably 0.1% or less.

The solution conditions at the time of the grain growth are the same as the conditions at the time of the above ripening. This is because, in both processes, the tabular grains are grown by Ostwald ripening and other fine grains are caused to disappear, and they are mechanically the same. With reference to details about the whole of the fine-grain emulsion addition method, reference can be made to descriptions disclosed in Japanese Patent Application Nos. 142635/1990 and 77261/1992 and JP-A No. 183417/1989.

To form fine grains substantially free from twinned crystal planes, they may be formed by adding an aqueous silver salt solution and an aqueous halide salt solution by the double jet method, with the excess halide ion concentration or excess silver ion concentration preferably being $10^{31\ 2}$ mol/liter or less.

Preferably, the fine-grain formation temperature is 50° C. or lower, more preferably 5 to 40° C., and further preferably 10 to 30° C. The dispersion medium is preferably a gelatin, which preferably contains 30% by weight or more, more preferably 60% by weight or more, and further preferably 80% by weight or more, of a low-molecular weight gelatin having preferably a molecular weight of 2,000 to $6\times10^4$, more preferably 5,000 to $4\times10^4$. The dispersion medium concentration is preferably 0.2% by weight or more, more preferably 0.5 to 5% by weight.

Method for Analyzing the Composition of Mixed Crystal Tabular Grains

The composition of each member of the multiple structure of the present invention can be judged by X-ray diffractometry. Examples in which X-ray diffractometry is applied to silver halide grains are described by H. Hirsch in the Journal of Photographic Science, Vol. 10 (1962), page 129 et seq.

When the lattice constant is determined by the halogen composition, peaks of diffraction occur at diffraction intensities that satisfy the Bragg's condition ($2d \sin\theta = n\lambda$). A standard measuring method is one in which diffraction curves of (220) planes of the silver halide are determined as targets using $K\beta^-$ ray of Cu as a ray source.

If the emulsion grains have two distinct layered structures, two diffraction maximums, corresponding to the different silver halide compositions in the layers, are generated, and as a result two peaks are formed in the diffraction curves. Actually, the technique for analyzing diffraction curves consisting of two diffraction components is well known, and assuming the diffraction components to be a function, such as the Gaussian function or the Lorentz function, the two components can be separated and their compositions can be derived based on to Vegard's rule.

On the other hand, in the case of an emulsion in which two kinds of grains different in halogen composition, and having no distinct layered structure, exist together, two peaks appear in X-ray diffractometry, but such an emulsion cannot exhibit the excellent photographic performance obtained in the present invention.

The use of an EPMA (electron-Probe Micro Analyzer), in addition to X-ray diffractometry, makes it possible to judge whether a silver halide emulsion in question is an emulsion according to the present invention or an emulsion having two kinds of silver halide grains, as mentioned above.

In this method, a sample is prepared so that emulsion grains are well dispersed, with them out of contact with each other, and the sample is irradiated with an electron beam. By X-ray analysis by electron beam excitation, elemental analysis of ultrafine parts becomes possible. By this method, X-ray intensities characteristic of silver and each halogens emitted from individual grains can be found, to determine the halogen composition of each grain.

If the halogen composition of each of at least 50 grains is identified by the EPMA method, it can be judged whether or not the particular emulsion falls within the emulsion according to the present invention.

Desirably, in the emulsion of the present invention, the halogen content is more uniform among the grains of the emulsion.

When the distribution of the halogen content among the grains is measured by the EPMA method, desirably the relative standard deviation is 50% or less, more desirably 35% or less, and particularly desirably 20% or less.

The different halogen composition for the whole of the silver halide in the grains can be obtained by annealing each of the samples and using the above X-ray diffraction.

During the formation of the mixed crystal tabular grains for use in the present invention, dislocation lines can be introduced to the grains by the halogen composition gap method, the halogen conversion method, the epitaxial growth method, or a combination of these methods. This is preferable, because pressure fogging characteristics, reciprocity characteristics, and color-sensitization characteristics are further improved. With respect to this, reference can be made to descriptions disclosed in JP-A Nos. 220238/1988, 26839/1989, 127635/1990, 189642/1991, 175440/1991, and 123346/1990, European Patent No. 0460656A1, and Journal of Imaging Science, Vol. 32, 160–177 (1988).

As a method for causing a sensitizing dye to be adsorbed more uniformly to the mixed crystal tabular grains according to the present invention, an effective method is for a salt that is less soluble than silver chloride to be formed on the high-silver-chloride surface of the outer shell of the outermost layer of the grains, uniformly from grain to grain.

As a silver salt that is less soluble than silver chloride, silver bromide, silver iodide, silver iodobromide, silver thiocyanate, silver selenocyanate, or mixed crystals of these can be mentioned, with preference given to silver bromide, silver iodide, and silver iodobromide. The amount of a silver salt that is less soluble than silver chloride is generally 20 mol % or less, preferably 10 mol % or less, more preferably 5 mol % or less, and further preferably 3 mol % or less, but 0.001 mol % or more based on all the grains.

As a method for causing a silver salt that is less soluble than silver chloride to be present on the surface of the tabular grains, a method in which a water-soluble halide salt and a water-soluble silver salt, having corresponding compositions, are added in a double jet manner, a method in which fine grains are added, or a method in which an agent for releasing, slowly, bromide ions or iodide ions, can be mentioned.

In the method in which a water-soluble halide salt and a water-soluble silver salt are simultaneously mixed and added, even though an aqueous halide salt solution is added with it diluted, since the halide ions are added in a free state, there is a limit on the minimization of locality (ununiform distribution) from grain to grain. In contrast, the method in which fine grains are added, or the method in which a slow-release agent is used, is a preferable method, because a salt that is less soluble than silver chloride is formed on the surface of grains, uniformly from grain to grain.

When fine grains are added, preferably the average sphere-equivalent diameter of the fine grains (a diameter of sphere corresponding to the volume of grain, with assuming the grain to be a sphere) is 0.1 $\mu$m or less, and more preferably 0.06 $\mu$m or less. The fine grains can be prepared continuously in a mixer provided near the reaction vessel, by feeding an aqueous silver salt solution and an aqueous solution of a salt capable of forming a silver salt having a solubility lower than that of silver chloride, and the resultant fine grains can be immediately added into the reaction vessel; or, after the fine grains are prepared batchwise in a separate container previously, they can be added. As the method in which a slow-release agent is used, methods disclosed in JP-B ("JP-B" means examined Japanese patent publication) No. 285942/1989 and Japanese patent application No. 58039/1993 can be applied.

The grains for use in the present invention can have epitaxial junction sites near their apexes. In this case, preferably the halogen composition of the junction sites is high in content of Br and/or I, in comparison with that of the substrate grains.

With respect to the grains for use in the present invention, when they are formed, subjected to a desilvering process, or chemically sensitized, it is preferable to allow a salt of metal ions to be present. To dope the grains with metal ions, when the grains are formed, the metal ions are dissolved in a solvent and then the solution is added, or, separately prepared fine grains doped with metal ions are added, to be deposited on the particular grains by Ostwald ripening.

As to the doping of grains with metal ions, selection can be made from a case in which the whole grains are doped, one in which only the core parts of the grains are doped, one in which only the shell parts of the grains are doped, one in which only the epitaxial parts of the grains are doped, and one in which only the substrate grains are doped.

For example, Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi can be used. These metals can be added if they are in the form of a salt that is soluble at the time when grains are formed, such as an ammonium salt, an acetate, a nitrate, a phosphate, a hydroxide, a six-coordinate complex, and a four-coordinate complex. Examples include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. As a ligand of the coordination compound, one can be selected from halo, aquo, amino, cyano, cyanate, thiocyanate, nitrosyl, thionitrosyl, oxo, and carbonyl. With respect to these metal compounds, only one can be used, but two or more can also be used in combination.

Preferably, the photographic emulsion to be used in the present invention can be spectrally sensitized with methine dyes and the like. Dyes that can be used include a cyanine dye, a merocyanine dye, a composite cyanin dye, a composite merocyanine dye, a halopolar cyanine dye, a hemicyanine dye, a styryl dye, and a hemioxonol dye. Particularly useful dyes are those belonging to a cyanine dye, a merocyanine dye, and a composite merocyanine dye. In these dyes, any of nuclei generally used in cyanine dyes as base heterocyclic nuclei can be applied. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; and a nucleus formed by fusing an cycloaliphatic hydrocarbon ring or an aromatic hydrocarbon ring to these nuclei, that is, such as an indolenine nucleus, a benzindolenine nucleus, an indole nucleus, a benzoxazole nucleus, a naphthooxazole nucleus, a benzothiazole nucleus, a naphthothiazole nucleus, a benzoselenazole nucleus, a benzimidazole nucleus, a quinoline nucleus, can be applied. These nuclei may be substituted on the carbon atom.

In the merocyanine dye or the composite merocyanine dye, as a nucleus having a ketomethylene structure, a 5- to 6-membered heterocyclic nucleus, such as a pyrazolin-5-one nucleus, a thiohydantoine nucleus, a 2-thiooxazolidin-2,4-dione nucleus, a thiazolidin-2,4-dione nucleus, a rhodanine nucleus, and a thiobarbituric acid nucleus, can be applied.

These sensitizing dyes can be used singly or in combination, and a combination of these sensitizing dyes is often used, particularly for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patent Nos. 1,344,281 and 1,507,803, JP-B Nos. 4936/1968 and 12375/1978, and JP-A Nos. 110618/1977 and 109925/1977.

Together with the sensitizing dye, a dye having no spectral sensitizing action itself, or a compound that does not substantially absorb visible light and that exhibits supersensitization, may be included in the emulsion.

The timing when the sensitizing dye is added to the emulsion may be at any stage known to be useful in the preparation of emulsions. The addition is carried out most usually at a time after the completion of chemical sensitization and before coating, but it can be carried out at the same time as the addition of a chemical sensitizer, to carry out spectral sensitization and chemical sensitization simultaneously, as described in U.S. Pat. Nos. 3,628,969 and 4,225,666; it can be carried out prior to chemical sensitization, as described in JP-A No. 113928/1983; or it can be carried out before the completion of the formation of the precipitate of silver halide grains to start spectral sensitization. Further, as taught in U.S. Pat. No. 4,225,666, these foregoing compounds may be added in portions, i.e., part of these compounds is added prior to chemical sensitization, and the rest is added after the chemical sensitization, and also the addition may be carried out at any time during the formation of silver halide grains, as disclosed, for example, in U.S. Pat. No. 4,183,756.

Generally the amount of the sensitizing dye to be added is of the order of $4\times10^{-6}$ to $8\times10^{-3}$ mol per mol of the silver halide, but when the silver halide grain size is 0.2 to 1.2 $\mu$m, which is more preferable, the amount of the sensitizing dye to be added is more effectively about $5\times10^{-5}$ to $2\times10^{-3}$ mol per mol of the silver halide.

The silver halide emulsion of the present invention can be subjected to at least one of sulfur sensitization, selenium sensitization, gold sensitization, palladium sensitization, noble metal sensitization, and reduction sensitization, in the chemical sensitization step for the silver halide emulsion. A combination of two or more sensitizations is preferable. Various types of emulsions can be produced, depending on the steps in which the chemical sensitization is carried out. There are a type wherein chemical sensitizing nuclei are embedded in grains, a type wherein chemical sensitizing nuclei are embedded at parts near the surface of grains, and a type wherein chemical sensitizing nuclei are formed on the surface. In the emulsion according to the present invention, the location at which chemical sensitizing nuclei are situated can be selected in accordance with the purpose. Generally preferable is the type wherein at least one chemical sensitizing nucleus is formed at parts near the surface of grains.

Chemical sensitizations that can be carried out preferably in the present invention are chalcogenide sensitization and noble metal sensitization, which may be used singly or in combination; and the chemical sensitization can be carried out by using active gelatin, as described by T. H. James in "The Theory of the Photographic Process," 4th edition, Macmillan, 1997, pages 67 to 76, or by using sulfur, selenium, tellurium, gold, platinum, palladium, or iridium, or a combination of these sensitizing agents, at a pAg of 5 to 10, a pH of 5 to 8, and a temperature of 30 to 80° C., as described in Research Disclosure, Vol. 120, Item 12008 (April 1974); Research Disclosure, Vol. 34, Item 13452 (June 1975); U.S. Pat. Nos. 2,642,361, 3,297,446, 3,772,031, 3,857,711, 3,901,714, 4,266,018, and 3,904,415, and British Patent No. 1,315,755. In the noble metal sensitization, a salt of a noble metal, such as gold, platinum, palladium, and iridium, can be used, and specifically gold sensitization, palladium sensitization, and a combination thereof are particularly preferable. In the case of gold sensitization, a known compound, such as chloroauric acid, potassium chloroaurate, potassium auriothiocyanate, gold sulfide, and gold selenide, can be used. The palladium compound means salts of divalent or tetravalent palladium salt. A preferable palladium compound is represented by $R_2PdX_6$ or $R_2PdX_4$, wherein R represents a hydrogen atom, an alkali metal atom, or an ammonium radical; and X represents a halogen atom, i.e. a chlorine atom, a bromine atom, or an iodine atom.

Specifically, $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$ is preferable. Preferably a gold compound and a palladium compound are used in combination with a thiocyanate or a selenocyanate.

As the sulfur sensitizer, hypo, thioureas, rhodanines, and sulfur-containing compounds described in U.S. Pat. Nos. 3,857,711, 4,266,018, and 4,054,457, can be used. The selenium sensitization is a preferable sensitization for the emulsion of the present invention. In the selenium sensitization, known unstable selenium compounds are used, specific such selenium compounds are colloidal metal selenium, selenoureas (e.g. N,N-dimethylselenourea and N,N-diethylselenourea), selenoketones, selenoamides. The chemical sensitization can be carried out in the presence of a so-called chemical sensitization auxiliary. As a useful chemical sensitization auxiliary, can be used a compound that is known to suppress fogging and to increase the sensitivity in the process of chemical sensitization, such as azaindene, azapyridazine, and azapyrimidine. Examples of chemical sensitization auxiliary improvers are described in U.S. Pat. Nos. 2,131,038, 3,411,914, and 3,554,757, JP-A No. 126526/1983, and by G. F. Duffin in "Photographic Emulsion Chemistry" mentioned above, pages 138 to 143.

Preferably that the silver halide emulsion of the present invention is subjected to reduction sensitization during the formation of the grains.

Herein, the reduction sensitization can be selected from a method wherein a reduction sensitizer is added to a silver halide emulsion; a method called silver ripening, wherein the growth or ripening is made in an atmosphere having a pAg as low as 1 to 7; and a method called high-pH ripening, wherein the growth or ripening is made in an atmosphere having a pH as high as 8 to 11. Two or more methods can also be used in combination.

The method in which a reduction sensitizer is added is preferable, in that the level of reduction sensitization can be subtly adjusted.

Known reduction sensitizers are, for example, stannous salts, ascorbic acid and its derivatives, amines and polyamines, hydrazine derivatives, formamidinesulfinic acid, silane compounds, and borane compounds. As the reduction sensitizer for use in the present invention, these known reduction sensitizers can be chosen, which may be used in a combination of two or more.

Alkinylamine compounds described in U.S. Pat. No. 5,389,510 can also be preferably used.

As the reduction sensitizers, stannous chloride, thiourea dioxide, dimethylamineborane, and ascorbic acid and its derivatives are preferable compounds. Since the amount of the reduction sensitizer to be added depends on the conditions of the production of the emulsion, the amount to be added should be suitably chosen, and it is suitably in the range of $10^{-7}$ to $10^{-3}$ mol per mol of the silver halide.

The reduction sensitizer is dissolved in a solvent, such as water, alcohols, glycols, ketones, esters, and amides, and the solution is added. The reduction sensitizer may be added to an aqueous solution of a water-soluble silver salt or a water-soluble alkali halide previously, and the resulting solution may be used to precipitate silver halide grains. Further, it is also preferable to use a method in which, in keeping with the growth of grains, the solution of the reduction sensitizer is added in portions or continuously over a long period of time.

Preferably an oxidizing agent for silver is added during the process of the production of the emulsion of the present invention. The oxidizing agent for silver refers to a compound that acts on metal silver to convert it to silver ions. Particularly useful is a compound that converts quite fine silver grains, which are concomitantly produced during the formation of silver halide grains and during the chemical sensitization, to silver ions. The thus produced silver ions may form a silver salt that is hardly soluble in water, such as a silver halide, silver sulfide, and silver selenide, or they may form a silver salt that is readily soluble in water, such as silver nitrate. The oxidizing agent for silver may be inorganic or organic. Example inorganic oxidizing agents include ozone, hydrogen peroxide and its adducts (e.g. $NaBO_2.H_2O_2.3H_2O$, $2NaCO_3.3H_2O_2$, $Na_4P_2O_7.2H_2O_2$, and $2Na_2SO_4.H_2O_2.2H_2O$); oxygen acid salts, such as peroxyacid salts (e.g. $K_2S_2O_8$, $K_2C_2O_6$, and $K_2P_2O_8$), peroxycomplex compounds (e.g. $K_2[Ti(O_2)C_2O_4].3H_2O$, $4K_2SO_4.Ti(O_2)OH.SO_4.2H_2O$, and $Na_3[VO(O_2)(C_2H_4)_2].6H_2O$), permanganates (e.g. $KMnO_4$), and chromates (e.g. $K_2Cr_2O_7$); halogen elements, such as iodine and bromine; perhalates (e.g. potassium periodate), salts of metals having higher valences (e.g. potassium hexacyanoferrate (III)), and thiosulfonates.

Examples of the organic oxidizing agents include quinones, such as p-quinone; organic peroxides, such as peracetic acid and perbenzoic acid; and compounds that can release active halogen (e.g. N-bromosuccinimido, chloramine T, and chloramine B).

Preferable oxidizing agents used in the present invention are such inorganic oxidizing agents as ozone, hydrogen peroxide and its adducts, halogen elements, and thiosulfonates, and such organic oxidizing agents as quinones. Use of a combination of the above reduction sensitization with the oxidizing agent for silver is a preferable mode. Disulfide compounds, described in U.S. Pat. No. 5,364,754 and European Patent No. 627657A2, can also be used preferably. Use is made of one selected from a method wherein after an oxidizing agent is used, reduction sensitization is carried out; a method wherein after reduction sensitization is carried out, an oxidizing agent is used; and a method wherein an oxidizing agent and a reduction sensitizer are present simultaneously.

In the photographic emulsion used in the present invention, various compounds can be incorporated for the purpose of preventing fogging during the process of the production of the light-sensitive material, during the storage of the light-sensitive material, or during the photographic processing, or for the purpose of stabilizing the photographic performance. That is, compounds known as antifoggants or stabilizers can be added, such as thiazoles including benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole); mercaptopyrimidines; mercaptotriazines; thioketo compounds, such as oxazolinthione; and azaindenes, such as triazaindenes, tetraazaindenes (particularly 4-hydroxy-substituted-1-1,3,3a,7-tetraazaindenes), and pentaazaindenes. For examples, those described in U.S. Pat. Nos. 3,954,474 and 3,982,947, and JP-B No. 28660/1987, can be used. A preferable compound is a compound described in Japanese Patent Application No. 47225/1987. In accordance with the purpose, the antifoggant and the stabilizer can be added at various times, for example, before the formation of the grains, during the formation of the grains, after the formation of the grains, in the step of washing with water, at the time of dispersion after the washing with water, before the chemical sensitization, during the chemical sensitization, after the chemical sensitization, and before the application. In addition to the case wherein the antifoggant and the stabilizer are added during the preparation of the emulsion, so that the antifogging effect and the stabilizing effect, which are their essential effects, may be achieved, they can be used for various other purposes, for example, for controlling the habit of the crystals of the grains, for making the grain size small, for reducing the solubility of the grains, for controlling the chemical sensitization, and for controlling the arrangement of the dyes.

To the light-sensitive material (also referred to as a photographic material or a photographic light-sensitive material) related to the present technique, may be added the above-mentioned various additives, and also other various additives in accordance with the purpose.

These additives are described in more detail in Research Disclosure, Item 17643 (December 1978); Research Disclosure, Item 18176 (November 1979); and Research Disclosure, Item 308119 (December 1989), and the particular parts are given below in a Table.

| | Additive | RD 17643 | RD 18716 | RD 308119 |
|---|---|---|---|---|
| 1 | Chemical sensitizers | p.23 | p.648 (right column) | p.996 |
| 2 | Sensitivity-enhancing agents | — | p.648 (right column) | — |
| 3 | Spectral sensitizers and Supersensitizers | pp.23–24 | pp.648 (right column)–649 (right column) | pp.996 (right column)–998 (right column) |
| 4 | Brightening agents | p.24 | — | p.998 (right column) |
| 5 | Antifogging agents and Stabilizers | pp.24–25 | p.649 (right column) | pp.998 (right column)–1000 (right column) |
| 6 | Light absorbers, Filter dyes, and UV Absorbers | pp.25–26 | pp.649 (right column)–650 (left column) | p.1003 (left to right column) |
| 7 | Stain-preventing agents | p.25 (right column) | p.650 (left to right column) | p.1002 (right column) |
| 8 | Image dye stabilizers | p.25 | — | p.1002 (right column) |
| 9 | Hardeners | p.26 | p.651 (left column) | pp.1004 (right column)–1005 (left column) |
| 10 | Binders | p.26 | p.651 (left column) | pp.1003 (right column)–1004 (right column) |
| 11 | Plasticizers and Lubricants | p.27 | p.650 (right column) | p.1006 (left to right column) |
| 12 | Coating aids and Surface-active agents | pp.26–27 | p.650 (right column) | pp.1005 (left column)–1006 (left column) |
| 13 | Antistatic agents | p.27 | p.650 (right column) | pp.1006 (right column)–1007 (left column) |
| 14 | Matting agents | — | — | pp.1008 (left column)–1009 (left column) |

It is suitable that the light-sensitive material according to the present invention is provided with at least one blue-sensitive silver halide emulsion layer, at least one green-sensitive silver halide emulsion layer, and at least one red-sensitive silver halide emulsion layer on a support and there is no particular restrictions on the number and order of the silver halide emulsion layers and the nonphotosensitive layers. A typical example is a silver halide photographic light-sensitive material having on a support at least one photosensitive layer that comprises a plurality of silver halide emulsion layers whose color sensitivities are substantially identical but whose sensitivities are different, the photosensitive layer being a unit photosensitive layer having color sensitivity to any of blue light, green light, and red light, and in a multilayer silver halide color photographic light-sensitive material, the arrangement of the unit photosensitive layers is generally such that a red-sensitive layer, a green-sensitive layer, and a blue-sensitive layer in the order stated from the support side are placed. However, the above order may be reversed according to the purpose and such an order is possible that layers having the same color sensitivity have a layer different in color sensitivity therefrom between them.

Nonphotosensitive layers such as various intermediate layers may be placed between, on top of, or under the above-mentioned silver halide photosensitive layers.

The intermediate layer may contain, for example, couplers and DIR compounds as described in JP-A Nos. 43748/1986, 113438/1984, 113440/1984, 20037/1986, and 20038/1986 and may also contain a color-mixing inhibitor as generally used.

Each of the silver halide emulsion layers constituting unit photosensitive layers respectively can preferably take a two-layer constitution comprising a high-sensitive emulsion layer and a low-sensitive emulsion layer as described in West Germany Patent No. 1,121,470 or British Patent No. 923,045. Generally, they are arranged preferably such that the sensitivities are decreased toward the support and each nonphotosensitive layer may be placed between the silver halide emulsion layers. As described, for example, in JP-A No. 112751/1982, 200350/1987, 206541/1987, and 206543/1987, a low-sensitive emulsion layer may be placed away from the support and a high-sensitive emulsion layer may be placed nearer to the support.

A specific example of the order includes an order of a low-sensitive blue-sensitive layer (BL)/high-sensitive blue-sensitive layer (BH)/high-sensitive green-sensitive layer (GH)/low-sensitive green-sensitive layer (GL)/high-sensitive red-sensitive layer (RH)/low-sensitive red-sensitive layer (RL), or an order of BH/BL/GL/GH/RH/RL, or an order of BH/BL/GH/GL/RL/RH stated from the side away from the support.

As described in JP-B No. 34932/1980, an order of a blue-sensitive layer/GH/RH/GL/RL stated from the side away from the support is also possible. Further as described in JP-A Nos. 25738/1981 and 63936/1987, an order of a blue-sensitive layer/GL/RL/GH/RH stated from the side away from the support is also possible.

Further as described in JP-B No. 15495/1974, an arrangement is possible wherein the uppermost layer is a silver halide emulsion layer highest in sensitivity, the intermediate layer is a silver halide emulsion layer lower in sensitivity than that of the uppermost layer, the lower layer is a silver halide emulsion layer further lower in sensitivity than that of the intermediate layer so that the three layers different in sensitivity may be arranged with the sensitivities successively lowered toward the support. Even in such a constitution comprising three layers different in sensitivity, an order of a medium-sensitive emulsion layer/high-sensitive emulsion layer/low-sensitive emulsion layer stated from the side away from the support may be taken in layers identical in color sensitivity as described in JP-A No. 202464/1984.

Further, for example, an order of a high-sensitive emulsion layer/low-sensitive emulsion layer/medium-sensitive emulsion layer or an order of a low-sensitive emulsion layer/medium-sensitive emulsion layer/high-sensitive emulsion layer can be taken. In the case of four layers or more layers, the arrangement can be varied as above.

As stated above, various layer constitutions and arrangements can be selected in accordance with the purpose of the particular light-sensitive material.

In the present invention, it is preferable to use a non-light-sensitive fine-grain silver halide. "Non-light-sensitive fine-grain silver halide" means silver halide fine grains that, when exposed imagewise to light to obtain dye images, are not sensitive to light and are substantially not developed when subjected to a development process, and preferably the non-light-sensitive fine-grain silver halide has not been fogged previously.

The fine-grain silver halide generally has a silver chloride content of 0 to 100 mol %, and it may contain silver bromide and/or silver iodide if necessary. Preferably the fine-grain silver halide contains silver bromide in an amount of 0.5 to 10 mol %, and silver iodide in an amount of 1 mol % or less.

Preferably the fine-grain silver halide has an average grain diameter (average value of diameters of projected areas assumed to be a circle) of 0.01 to 0.5 μm, more preferably 0.02 to 0.2 μm.

The fine-grain silver halide can be prepared in the same manner as that for usual light-sensitive silver halides. In that case, it is not necessary for the surface of the silver halide grains to be optically sensitized or spectrally sensitized. However, prior to the addition thereof to a coating solution, preferably a known stabilizer, such as triazole-series compounds, azaindene-series compounds, benzothiazolium-series compounds, mercaptol-series compounds, or zinc compounds, is previously added. It is possible to contain colloid silver preferably in the layer containing the fine-grain silver halide grains.

Preferably, the light-sensitive material according to the present invention contains, irrespective of the amount of developed silver produced by the development processing, a fogging agent, a development accelerator, a silver halide solvent, or a compound capable of releasing precursors of them, as described in JP-A No. 106052/1989.

Preferably the light-sensitive material according to the present invention contains a dye dispersed by methods described in International Publication No. W088/04794 and Published searched patent publication No. 502912/1989, or a dye described in EP No. 317,308A, U.S. Pat. No. 4,420,555, or JP-A No. 259358/1989.

As a colored coupler to rectify the unnecessary absorption of color-forming dyes, those couplers described in, paragraph VII-G of *Research Disclosure* No. 17643, paragraph VII-G of ibid. No. 307105, U.S. Pat. No. 4,163,670, JP-B No. 39413/1982, U.S. Pat. Nos. 4,004,929 and 4,138,258, and British Patent No. 1,146,368 are preferable. Further, it is preferable to use couplers to rectify the unnecessary absorption of color-forming dyes by a fluorescent dye released upon the coupling reaction, as described in U.S. Pat. No. 4,774,181 and couplers having a dye precursor, as a group capable of being released, that can react with the developing agent to form a dye, as described in U.S. Pat. No. 4,777,120.

Other compounds that can be incorporated in the light-sensitive material according to the present invention include couplers which release a DIR redox compound, couplers which release a DIR coupler, and redox compounds which release a DIR coupler or a DIR redox, as described in JP-A Nos. 185950/1985 and 24252/1987.

In the color light-sensitive material according to the present invention, various antiseptics and antifungal agents, such as phenetyl alcohol, and 1,2-benzisothiazoline-3-one, n-butyl p-hydroxybenzoate, phenol, 4-chloro-3,5-dimethylphenol, 2-phenoxyethanol, and 2-(4-thiazolyl) bezimidazole, as described in JP-A Nos. 257747/1988, 272248/1987, and 80941/1989, are preferably added.

The present invention can be applied to various color light-sensitive materials. As the representative examples, can be mentioned, for example, a color negative film for general purpose and cine-film, a color reversal film for slide or television, a color paper, a color positive film and a color reversal paper.

Suitable supports for use in the present invention are described in, for example, in the above-mentioned *Research Disclosure* No. 17643, page 28, ibid. No. 18716, from page 647, right column to page 648, left column and ibid. No. 307105, page 879.

As the base (support) to be used in the light-sensitive material according to the present invention, any transparent base or reflective base can be used if it can be coated with photographic emulsion layers, and examples are bases of glass, paper, and plastic film. As the plastic film to be used in the present invention, for example, a polyester film, a polyamide film, a polycarbonate film, and a polystyrene film, for example, of a polyethylene terephthalate, a polyethylene naphthalate, a cellulose triacetate, or a cellulose nitrate, can be used.

A compound (DIR coupler) that releases a development inhibitor accompanied with the coupling reaction with a color-forming reducing agent can be used in the present invention. As the DIR coupler, those described in patents cited in paragraph VII-F of the above-mentioned *Research Disclosure* No. 17643 and in paragraph VII-F of ibid. No. 307105, JP-A Nos. 151944/1982, 154234/1982, 184248/1985, 37346/1988, and 37350/1986, and U.S. Pat. Nos. 4,248,962 and 4,782,012 are preferable.

In the light-sensitive material according to the present invention, preferably the total film thickness of all the hydrophilic colloid layers on the side having emulsion layers is 28 μm or below, more preferably 23 μm or below, further more preferably 18 μm or below, and particularly preferably 16 μm or below. Preferably the film swelling speed $T_{1/2}$ is 30 sec or below, more preferably 20 sec or below. The term "film thickness" means film thickness measured after moisture conditioning at 25° C. and a relative humidity of 55% for two days, and the film swelling speed $T_{1/2}$ can be measured in a manner known in the art. For example, the film swelling speed $T_{1/2}$ can be measured by using a swellometer (swell-measuring meter) of the type described by A. Green et al. in *Photographic Science and Engineering*, Vol. 19, No. 2, pp. 124–129, and $T_{1/2}$ is defined as the time required to reach a film thickness of 1/2 of the saturated film thickness that is 90% of the maximum swelled film thickness that will be reached when the film is treated with a color developer at 30° C. for 3 min 15 sec.

The film swelling speed $T_{12}$ can be adjusted by adding a hardening agent to the gelatin that is a binder or by changing the time conditions after the coating. Preferably the ratio of swelling is 150 to 400%. The ratio of swelling is calculated from the maximum swelled film thickness obtained under the above conditions according to the formula: (Maximum swelled film thickness–Film thickness)/Film thickness.

It is preferable that the light-sensitive material according to the present invention is provided a hydrophilic colloid layer (designated as a backing layer) having a total dried film thickness of 2 μm to 20 μm at the opposite side of having emulsion layers. In such a backing layer, it is preferable to be contained the above-mentioned light-absorbent, filter-dye, UV-absorbent, static preventer, film-hardening agent, binder, plasticizer, lubricant, coating auxiliary, and surface-active agent. The swelling ratio of backing layer is preferably 150 to 500%.

Processing materials and processing methods used in the present invention will now be described in detail. In the present invention, the light-sensitive material is alkali-activated (silver development/cross oxidation of the built-in color developing agent (the built-in reducing agent)), desilvered, washed with water, and stabilized. In some cases, after the washing with water or the stabilizing processing, a treatment of alkalinization for color-formation intensification (alkali treatment) may be carried out.

When the light-sensitive material according to the present invention is developed, an alkali activating bath can be used. The alkali activating bath can include an auxiliary developing agent released from the light-sensitive material during a continuous processing in a part. The alkali activating bath used in the present invention preferably has a pH of 8 to 13, more preferably 9 to 12.

Example antioxidants that may be used in the alkali activating solution for use in the present invention include sodium sulfite, potassium sulfite, lithium sulfite, ammonium sulfite, sodium bislfite, pottasium metabisulfite, formaldehyde sodium bisulfite, and hydroxylamine-sulfate, which are generally used in an amount in the range of 0.1 mol/liter or below, and preferably 0.001 to 0.02 mol/liter. If a high-silver-chloride emulsion is used in the light-sensitive material, the above compound is generally used in an amount of 0.001 mol/liter or below, and preferably it is not used at all in some cases.

In the present invention, instead of the above hydroxylamine or sulfite ions, an organic preservative can be preferably used.

Herein the term "organic preservatives" refers generally to organic compounds that reduce the deteriotation speed of the auxiliary developing agent that is partially dissolved out from the photographic material when added to the alkali activating solution. That is, organic preservatives are organic compounds that have a function of preventing auxiliary developing agents from being oxidized with air or the like; and particularly effective organic preservatives are other hydroxylamine derivatives (excluding hydroxylamine), hydroxamic acids, hydrazines, phenols, α-hydroxyketones, α-aminoketones, saccarides, monoamines, diamines, polyamines, quaternary ammoniums, nitroxy radicals, alcohols, oximes, diamide compounds, and fused-ring-type amines. These are described, for example, in JP-A Nos. 4235/1988, 5341/1988, 30845/1988, 21647/1988, 44655/1988, 46454/1988, 53551/1988, 43140/1988, 56654/1988, 58346/1988, 43138/1988, 146041/1988, 44657/1988, and 44656/1988, U.S. Pat. Nos. 3,615,503 and 2,494,903, and JP-B No. 30496/1973. Further, other preservatives that may be contained, if required, include, for example, various metals described in JP-A Nos. 44148/1982 and 53749/1982, salicylic acids described in JP-A No. 180588/1984, alkanolamines described in JP-A No. 3532/1979, polyethyleneimines described in JP-A No. 94349/1981, and aromatic polyhydroxy compounds described in U.S. Pat. No. 3,746,544. In particular, preferably contained are alkanolamines described in JP-A No. 97355/1992, pages 631 to 632, and dialkylhydroxylamines described therein, pages 627 to 630. Further, it is also preferable to use a combination of dialkylhydroxylamines and/or hydrazine derivatives with alkanolamines, or a combination of α-amino acids, represented by glycine, with dialkylhydroxylamines, as described in European Patent No. 530,921A1.

These compounds are preferably used in an amount of $1\times10^{-3}$ to $5\times10^{-1}$ mol, and more preferably $1\times10^{-2}$ to $2\times10^{-1}$ mol, per liter of the alkali activating solution.

In the present invention, the alkali activating solution contains halide ions, such as chloride ions, bromide ions, and iodide ions. Preferably, when a high silver-chloride emulsion is used, chloride ions are contained in an amount of $3.5\times10^{-3}$ to $3.0\times10^{-1}$ mol/liter, and more preferably $1\times10^{-2}$ to $2\times10^{-1}$ mol/liter, and/or bromide ions in an amount of $0.5\times10^{-5}$ to $1.0\times10^{-3}$ mol/liter, and more preferably $3.0\times10^{-5}$ to $5\times10^{-4}$ mol/liter.

Herein the halide ions may be added directly to the alkali activating solution, or they may be dissolved out from the photographic material into the alkali activating solution during the development processing.

If the halide ions are added to the alkali activating solution, the halide ion source may be a sodium salt, a potassium salt, an ammonium salt, a lithium salt, or a magnesium salt, of the halide ion. When the halide ions are dissolved out from the photographic material, the halide ions are supplied mainly from the silver halide emulsion, but they may also be supplied from some other source.

To retain the above pH, it is preferable to use various buffers, examples of which are carbonates, phosphates, brorates, tetraborates, hydroxybenzoates, glycinates, N,N-dimethylglycinates, leucinates, norleucinates, guaninates, 3,4-dihydroxyphenylalaninates, alaninates, aminobutylates, 2-amino-2-methyl-1,3-propandiol salts, valerates, prolinates, trishydroxyaminomethane salts, and lysinates. In particular, carbonates, phosphates, tetraborates, and hydroxybenzoates are excellent in solubility and buffering function at a pH in the range of 9.0 or over, and when they are added to the developing solution (the alkali activating solution), the photographic performance is not adversely affected, so that they are preferably used.

Specific examples of these buffers are lithium carbonate, sodium carbonate, potassium carbonate, potassium bicarbonate, tripotassium phosphate, trisodium phosphate, dipotassium phosphate, disodium phosphate, potassium borate, sodium borate, sodium tetraborate, potassium tetraborate, sodium o-hydroxybenzoate (sodium salicylate), and potassium 5-sulfo-2-hydroxybenzoate (potassium 5-sulfosalicylate).

The amount of the buffers to be added to the alkali activating solution is preferably 0.05 mol/liter or over, and particularly preferably 0.1 to 0.4 mol/liter.

In addition, in the alkali activating solution, as a sediment-preventive agent against calcium and magnesium, or as an agent for stabilizing the developing solution, various chelating agents can be used. Examples are nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, 1,2-diaminopropanetetraacetic acid, glycol ether diaminetetraacetic acid, ethylenediamine orthohydroxyphenylacetic acid, 2-phosphonobutane-1,2,4-tricarboxylic acid, 1-hydroxyethylidene-1,1-diphosphonic acid, and 1,2-dihydroxybenzene-4,6-disulfonic acid, and their alkali metal salts. Two or more of these chelating agents may be used in combination, if necessary.

With respect to the amount of these chelating agents to be added, preferably the amount is enough to sequester the metal ions in the alkali activating solution, and, for example, these chelating agents are generally used in an amount in the order of 0.1 to 10 g per liter.

In the present invention, if required, an arbitrary antifoggant can be added. As the antifoggant, nitrogen-containing heterocyclic compounds, and alkali metal halide, such as sodium chloride, potassium bromide, and potassium iodide, are used. Typical examples of the nitrogen-containing heterocyclic compounds are benzotriazole, 5-nitrobenzotriazole, 5-methylbenzotriazole, 6-nitrobenzimidazole, 5-nitroisoimidazole, 2-thiazolylbenzimidazole, indazole, hydroxyazaindolizine, adenine, and 1-phenyl-5-mercaptotetrazole, or their derivatives.

The amount of the nitrogen-containing heterocyclic compounds to be added is generally $1\times10^{-5}$ to $1\times10^{-2}$ mol/liter, and preferably $2.5\times10^{-5}$ to $1\times10^{-3}$ mol/liter.

In the alkali activating solution, if necessary, an arbitrary development accelerator can be added, examples of which are the following compounds: thioether-series compounds described, for example, in JP-B Nos. 16088/1962, 5987/1962, 7826/1963, 12380/1969, and 9019/1970, and U.S. Pat. No. 3,813,247; p-phenylenediamine-series compounds described in JP-A Nos. 49829/1977 and 15554/1975; quaternary ammonium salts described, for example, in JP-A No. 137726/1975, JP-B No. 30074/1969, and JP-A Nos. 156826/1981 and 43429/1977; amine-series compounds described, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; and imidazoles and polyalkylene oxides described, for example, in JP-B Nos. 16088/1962 and 25201/1967 U.S. Pat. No. 3,128,183, JP-B Nos. 11431/1966 and 23883/1967, and U.S. Pat. No. 3,532,501.

Preferably the alkali activating solution contains a fluorescent whitening agent. In particular, it is preferable to use 4,4'-diamino-2,2'-disulfostilbene-series compounds. Specifically, commercially available fluorescent whitening agents, such as compounds described, for example, in "Senshoku Note," 19th edition, pages 165 to 168, and compounds described in JP-A No. 242943/1992, pages 3 to 7, can be used. The amount to be added is generally 0.1 to 10 g/liter, and preferably 0.5 to 5 g/liter.

The processing temperature of the alkali activating solution to be applied to the present invention is generally 20 to 50° C., and preferably 30 to 45° C. The processing time is generally 5 sec to 2 min, and preferably 10 sec to 1 min. With respect to the replenishing rate, although a small amount is preferable, the replenishing rate is generally 15 to 600 ml, preferably 25 to 200 ml, and more preferably 35 to 100 ml, per $m^2$ of the photographic material.

After the development, a desilvering process can be carried out. The desilvering process comprises a fixing process, or both a bleaching process and a fixing process. When both bleaching and fixing are carried out, the bleaching process and the fixing process may be carried out separately or simultaneously (bleach-fixing process). Also, according to the purpose, the processing may be carried out in a bleach-fixing bath having two successive tanks; or the fixing process may be carried out before the bleach-fixing process; or the bleaching process may be carried out after the bleach-fixing process.

In some cases, it is preferable to carry out the stabilizing process, to stabilize silver salts and dye images, without carrying out the desilvering process after the development.

After the development, image-intensifying process (intensification) can be performed using peroxides, halorous acids, iodoso compounds, and cobalt (III) complex compounds, as described, for example, in West Germany Patent (OLS) Nos. 1,813,920, 2,044,993, and 2,735,262, and JP-A Nos. 9728/1973, 84240/1974, 102314/1974, 53826/1976, 13336/1977, and 73731/1977. To further intensify the image, an oxidizing agent for intensifying the image can be added to the above developer, so that the development and the intensification may be carried out at the same time in one bath. In particular, hydrogen peroxide is preferable, because the amplification rate is high. These intensification methods are preferable processing methods in view of environmental conservation. This is because the amount of silver in the light-sensitive material can be reduced considerably, and therefore, for example, a bleaching process is not required and silver (or silver salts) will not be released, for example, by a stabilizing process or the like.

Example bleaching agents for use in the bleaching solution or the bleach-fix solution include, for example, compounds of polyvalent metals, such as iron (III), cobalt (III), cromium (IV), and copper (II); peracids; qunones; and nitro compounds. Typical compounds are iron chloride, ferricyanides, dichromates, organic complex salts of iron (III) (e.g. metal salts of ethylenediaminetetraacetic acid, diethylenetriaminepentaacetic acid, cyclohexanediaminetetraacetic acid, 1,3-diaminopropanetetraacetic acid, methylimiodiacetic acid; and metal salts of aminopolycarboxylic acids, as described in JP-A No. 365036/1992, pages 5 to 17), persulfates, permanganates, bromates, hydrogen peroxide and compounds releasing thereof (e.g. percarbonic acid and perboric acid), and nitrobenzenes. Among them, aminopolycarboxylic acid iron (III) complex salts, such as ethylenediaminetetraacetatic acid iron (III) complex salt and 1,3-diaminopropanetetraacetic acid iron (III) complex salt, hydrogen peroxide, persulfates, and the like are preferred, in view of rapid processing and the prevention of environmental pollution.

The bleaching solution and bleach-fix solution that use these aminopolycarboxylic acid iron (III) complex salts, are generally used at a pH of 3 to 8, and preferably 5 to 7. The bleaching solution that uses persulfates or hydrogen peroxide is generally used at a pH of 4 to 11, and preferably 5 to 10.

In the bleaching solution, the bleach-fix solution, and the bath preceding them, if required, a bleach-accelerating agent can be used. Specific examples of useful bleach-accelerating agents include compounds having a mercapto group or a disulfide bond, as described, for example, in U.S. Pat. No. 3,893,856, West Germany Patent No. 1,290,812, JP-A No. 95630/1978, and Research Disclosure No. 17129 (July 1978); thiazolidine derivatives described in JP-A No. 140129/1975; thiourea derivatives described in U.S. Pat. No. 3,706,561; iodide salts described in JP-A No. 16235/1983; polyoxyethylene compounds described in West Germany Patent No. 2,748,430; and polyamine compounds described in JP-B No. 8836/1970; and iodide ions.

Above all, compounds having a mercapto group or a disulfide group are preferable, because they are high in accelerating effect. When color photographic materials for photography are desilvered, these bleach-accelerating agents are particularly effective.

With respect to the accelerating agent for persulfate bleaching, complex salts of 2,6-pyridinedicarboxylic acid or 2-pyridinecarboxylic acid with iron (III) ion, as described in JP-A No. 214365/1994 (European Patent No. 0602600A1), are effective. With respect to the accelerating agent for hydrogen peroxide bleaching, metal complex salts of organic acids, described in JP-B Nos. 16067/1986 and 19024/1986, are effective.

In the bleaching solution, the bleach-fix solution, and the fixing solution, use can be made of known additives, such as a rehalogenating agent, including ammonium bromide and ammonium chloride; a pH buffering agent, including ammonium nitrate, acetic acid, boric acid, citric acid or its salt, tartaric acid or its salt, succinic acid or its salt, and imidazole; and a metal corrosion-preventive agent, including ammonium sulfate. In particular, it is preferable to contain an organic acid, to prevent bleach stain. The organic acid is a compound having an acid dissociation constant (pKa) of 2 to 7, and specifically acetic acid, succinic acid, citric acid, and propionic acid are preferable.

Example fixing agents for use in the fixing solution and the bleach-fix solution include thiosulfates, thiocyanates, thioureas, a large amount of iodide salts, and thioether-series compounds, metho-ionic-series compounds, and nitrogen-containing heterocyclic compounds, having a sulfide group, as described in JP-A No. 365037/1992, pages 11 to 21, and JP-A No. 66540/1993, pages 1088 to 1092. Among these, use of thiosulfates is usual, and ammonium thiosulfate is most widely used. A combination of thiosulfates with thiocyanates, thioether compounds, thiourea, or metho-ionic compounds, is also preferable.

Preferable preservatives for the fixing solution and the bleach-fix solution are sulfites, bisulfites, carbonylbisulfite adducts, and sulfinic acid compounds described in European Patent No. 294769A. In the fixing solution, the bleaching solution, and the bleach-fix solution, to stabilize the solutions, it is preferable to add any of various aminopolycarboxylic acids, organic phosphonic acids (e.g. 1-hydroxyethylidene-1,1-diphosphonic acid, N,N,N',N'-ethylenediaminetetraphosphonic acid, and 2-phosphonobutane-1,2,4-tricarboxylic acid) and sodium stannate.

In the fixing solution and the bleach-fix solution, further, for example, any of various fluorescent whitening agents, antifoaming agents, surface-active agents, polyvinylpyrolidones, and methanol can be contained.

The processing temperature of the desilvering step is generally 20 to 50° C., and preferably 30 to 45° C. The processing time is generally 5 sec to 2 min, and preferably 10 sec to 1 min. Although a small replenishing rate is preferable, the replenishing rate is generally 15 to 600 ml, preferably 25 to 200 ml, and more preferably 35 to 100 ml, per $m^2$ of the photographic material. The processing is also preferably carried out without replenishment in such a way that the evaporated amount is supplemented with water.

The photographic material according to the present invention is generally passed through a washing (rinsing) step after the desilvering process. If a stabilizing process is carried out, the washing step can be omitted. In such a stabilizing process, processes described in JP-A Nos. 8543/1982, 14834/1983, and 220345/1985, and all known processes described in JP-A Nos. 127926/1983, 137837/1983, and 140741/1983, can be used. A washing-stabilizing process, in which a stabilizing bath containing a dye stabilizer and a surface-active agent typically used for the processing of color photographic materials for photographing is used as a final bath, can be carried out.

In the washing water and stabilizing solution, use can be made of a water softener, such as sulfites, inorganic phosphoric acids, polyaminocarboxylic acids, and organic aminophosphoric acids; a metal salt, such as Mg salts, Al salts, and Bi salts; a surface-active agent, a hardener, a pH buffer, a fluorescent whitening agent, and a silver-salt-forming agent, such as nitrogen-containing heterocyclic compounds.

Example dye-stabilizing agents of the stabilizing solution include, for example, aldehydes, such as formaldehyde and glutaraldehyde; N-methylol compounds, hexamethylenetetramine, or aldehyde sulfite adducts.

The pH of the washing water and the stabilizing solution is generally 4 to 9, and preferably 5 to 8. The processing temperature is generally 15 to 45° C., and preferably 25 to 40° C. The processing time is 5 sec to 2 min, and preferably 10 sec to 40 sec.

The overflow solution associated with the replenishment of the above washing water and/or the stabilizing solution, can be reused in other processes, such as the desilvering process.

The amount of the washing water and/or the stabilizing solution can be set in a wide range depending on various conditions, and the replenishing rate is preferably 15 to 360 ml, and more preferably 25 to 120 ml, per $m^2$ of the photographic material. To reduce the replenishing rate, it is preferable to use multiple tanks and a multi-stage countercurrent system. In particular, it is preferable to use 2 to 5 tanks. In order to prevent the propagation of bacteria and adhesion stain of suspended matter on the photographic material that will result from reduction in the amount of these solutions, use can be made of bactericides, such as sodium chlorinated isocynurate, cyapentazoles, and isothiazolone compounds described in JP-A No. 8542/1982; other benzotriazoles; and bactericides described by Hiroshi Horiguchi in "Bokin-bobaizai no Kagaku" (1986, Sankyo-shuppan); in "Biseibutsu no Mekkin, Sakkin, Bobai Gijutsu," edited by Eisei Gijutsu-kai (1982, Kogyo Gijutsu-kai); and in "Bokin Babai-zai Jiten," edited by Nihon Bokin Bobai-gakkai (1986). Further, a method of reducing Mg and Ca ions, as described in JP-A No. 288838/1987, is particularly preferably used.

In the present invention, in order to save water, water can be used that has been obtained by treating the overflow solution or the in-tank solution using a reverse osmosis membrane. For example, the treatment by reverse osmosis is preferably carried out for water from the second tank, or the more latter tank of the multi-stage countercurrent washing process and/or the stabilizing process. Specifically, in the case of a two-tank system, the water in the second tank is treated by a reverse osmosis membrane, and in the case of a four-tank system, the water in the third tank or the fourth tank is treated by a reverse osmosis membrane, and then the passed water is returned to the particular tank (the tank from which water for the reverse osmosis treatment has been taken) or is brought to a washing tank and/or a stabilizing tank situated downstream, for use. It is also one mode that the concentrated solution is returned to a tank situated upstream of that particular tank and further to the desilvering bath.

As the material of the reverse osmosis membrane, for example, cellulose acetates, crosslinked polyamides, polyethers, polysulfons, polyacrylic acids, and polyvinylene carbonates can be used. The pressure of the pumped solution used for these membranes is preferably 2 to 10 $kg/cm^2$ and particularly preferably 3 to 7 $kg/cm^2$.

In the present invention, preferably the stirring is intensified as much as possible. To intensify the stirring, specifically a method wherein a jet stream of a processing solution is caused to impinge on the emulsion surface of a photographic material, as described in JP-A Nos. 183460/1987 and 183461/1987; a method wherein a rotating means is used to increase the stirring effect, as described in JP-A No. 183461/1987; a method wherein a photographic material is moved, with the emulsion surface of the material being in contact with a wiper blade provided in a solution, so that a turbulent flow may occur near the emulsion surface, to improve the stirring effect; and a method wherein the total amount of a processing solution to be circulated is increased, can be mentioned. These means of improving the stirring are useful in any of the developing solution, the bleaching solution, the fixing solution, the bleach-fix solution, the stabilizing solution, and the washing water. These methods are effective in that the effective constituents in the solution are supplied to the photographic material and the diffusion of unnecessary components in the photographic material is promoted.

In the present invention, any state of the solution opening rate [contact area of air ($cm^2$)/solution volume ($cm^3$)] of any of the baths can exhibit excellent performance, but in view of the stability of the solution components, preferably the solution opening rate is 0 to 0.1 $cm^{-1}$. In the continuous processing, from a practical point of view, the solution opening rate is preferably 0.001 to 0.05 $cm^{-1}$, and more preferably 0.002 to 0.03 $cm^{-1}$.

The automatic developing machine used for the photographic material according to the present invention is preferably provided with a means of transporting a photographic material, as described in JP-A No. 191257/1985, 191258/1985, and 191259/1985. Such a transporting means can reduce remarkably the carry-in of the processing solution from a preceding bath to a succeeding bath. Therefore it is high in the effect of preventing the performance of a processing solution from being deteriorated. Such an effect is particularly effective in shortening the processing time of each process and in reducing the replenishing rate of the processing solution. To shorten the processing time, it is preferable to shorten the crossover time (the aerial time), and a method wherein a photographic material is transported between processes through a blade having a screening effect, as described, for example, in JP-A No. 86659/1992, FIG. 4, 5, or 6, and JP-A No. 66540/1993, FIG. 4 or 5, is preferable.

Further, if each of the processing solutions in the continuous process is concentrated due to evaporated, preferably water is added to compensate for the evaporation.

The processing time in each process for use in the present invention means the time required from the start of the processing of the photographic material at any process, to the start of the processing in the next process. The actual processing time in an automatic developing machine is determined generally by the linear speed and the volume of the processing bath, and in the present invention, as the linear speed, 500 to 4,000 mm/min can be mentioned as a guide. Particularly in the case of a small-sized developing machine, 500 to 2,500 mm/min is preferable.

The processing time in the whole processing steps, that is, the processing time from the developing process to the drying process, is preferably 360 sec or below, more preferably 120 sec or below, and particularly preferably 90 to 30 sec. Herein the processing time means the time from the dipping of the photographic material into the developing solution, till the emergence from the drying part of the processor.

Techniques, including the arrangement of layers, silver halide emulsions, dye-forming couplers, functional couplers, including DIR couplers; various additives and the like, and development processing, that can be used for the emulsion of the present invention and the photographic light-sensitive material, in which the said emulsion is used, are described in European Patent No. 0565096A1 (published on Oct. 13, 1993) and patents cited therein. Items and corresponding sections describing the items are listed below.

1. Layer constitution: page 61, lines 23 to 35; page 61, line 41, to page 62, line 14
2. Intermediate layers: page 61, lines 36 to 40
3. Interlayer-effect-providing layers: page 62, lines 15 to 18
4. Silver halide halogen compositions: page 62, lines 21 to 25
5. Silver halide grain crystal habit: page 62, lines 26 to 30
6. Silver halide grain sizes: page 62, lines 31 to 34
7. Emulsion preparing methods: page 62, lines 35 to 40
8. Silver halide grain size distributions: page 62, lines 41 to 42
9. Tabular grains: page 62, lines 43 to 46
10. Internal structures of grains: page 62, lines 47 to 53
11. Latent image formation types of emulsions: page 62, line 54, to page 63, line 5
12. Physical ripening/chemical ripening of emulsions: page 63, lines 6 to 9
13. Use of mixtures of emulsions: page 63, lines 10 to 13
14. Fogged emulsions: page 63, lines 14 to 31
15. Non-light-sensitive emulsions: page 63, lines 32 to 43
16. Coated amount of silver: page 63, lines 49 to 50
17. Photographic additives: These additives are described in more detail in Research Disclosure(RD), Item 17643 (December 1978); Research Disclosure, Item 18176 (November 1979); and Research Disclosure, Item 307105 (November 1989), and the items and related parts are given below.

| | Additive | RD 17643 (December, 1978) | RD 18716 (November, 1979) | RD 307105 (November, 1989) |
|---|---|---|---|---|
| 1 | Chemical sensitizers | p.23 | p.648 (right column) | p.866 |
| 2 | Sensitivity-enhancing agents | — | p.648 (right column) | — |
| 3 | Spectral sensitizers and Supersensitizers | pp.23–24 | pp.648 (right column)–649 (right column) | pp.866–868 |
| 4 | Brightening agents | p.24 | p.647 (right column) | p.868 |
| 5 | Antifogging agents and Stabilizers | pp.24–25 | p.649 (right column) | pp.868–870 |
| 6 | Light absorbers, Filter dyes, and UV Absorbers | pp.25–26 | pp.649 (right column)–650 (left column) | p.873 |
| 7 | Stain-preventing agent | p.25 (right column) | p.650 (left to right column) | p.872 |
| 8 | Image dye stabilizers | p.25 | p.650 (left column) | p.872 |
| 9 | Hardeners | p.26 | p.651 (left column) | pp.874–875 |
| 10 | Binders | p.26 | p.651 (left column) | pp.873–874 |
| 11 | Plasticizers and Lubricants | p.27 | p.650 (right column) | p.876 |
| 12 | Coating aids and Surface-active agents | pp.26–27 | p.650 (right column) | pp.875–876 |
| 13 | Antistatic agents | p.27 | p.650 (right column) | pp.876–877 |
| 14 | Matting agent | — | — | pp.878–879 |

The color photographic light-sensitive material according to the present invention can also be developed by methods described in the above-mentioned RD No. 17643, pages 28 to 29, the above-mentioned RD No. 18716, 651, the left column to the right column, and the above-mentioned RD No. 307105, pages 880 to 881.

18. Formaldehyde scavengers: page 64, lines 54 to 57
19. Mercapto-series type antifoggants: page 65, lines 1 to 2
20. Agents for releasing fogging agents, etc.: page 65, lines 3 to 7
21. Dyes: page 65, lines 7 to 10
22. Color couplers in general: page 65, lines 11 to 13

23. Yellow, magenta, and cyan couplers: page 65, lines 14 to 25
24. Polymer couplers: page 65, lines 26 to 28
25. Diffusible dye-forming couplers: page 65, lines 29 to 31
26. Colored couplers: page 65, lines 32 to 38
27. Functional couplers in general: page 65, lines 39 to 44
28. Bleach accelerator-releasing couplers: page 65, lines 45 to 48
29. Development accelerator-releasing couplers: page 65, lines 49 to 53
30. Other DIR couplers: page 65, line 54, to page 66, line 4
31. Coupler dispersion methods: page 66, lines 5 to 28
32. Antifungs/mildew-proofing agents: page 66, lines 29 to 33
33. Types of light-sensitive materials: page 66, lines 34 to 36
34. Film thickness and swelling speed of photosensitive layers: page 66, line 40, to page 67, line 1
35. Backing layers: page 67, lines 3 to 8
36. Developing process in general: page 67, lines 9 to 11
37. Developers and developing agents: page 67, lines 12 to 30
38. Additives to developers: page 67, lines 31 to 44
39. Reversal process: page 67, lines 45 to 56
40. Opening rate of processing solutions: page 67, line 57, to page 68, line 12
41. Development time: page 68, lines 13 to 15
42. Bleach-fix, bleaching, and fixing: page 68, line 16, to page 69, line 31
43. Automatic processors: page 69, lines 32 to 40
44. Washing, rinsing, and stabilization: page 69, line 41, to page 70, line 18
45. Replenishment and reuse of processing solutions: page 70, lines 19 to 23
46. Light-sensitive materials built-in a developing agent: page 70, lines 24 to 33
47. Development processing temperature: page 70, lines 34 to 38
48. Application to films with lens: page 70, lines 39 to 41

More preferably, in the present invention, the light-sensitive material processed in the above manner is subjected to image processing described in JP-A Nos. 13932/1994 and 245062/1994.

The above image processing is connected to an input means of reading the image record of the subject recorded and fixed in the processed light-sensitive material, and to an input conversion means of converting to input signals corresponding thereto, and the image processing is completed by demodulating colorimetry signals representing colorimetry information of the subject corresponding to the first-mentioned signals. More preferably, the image processing is used by connecting it to an output means of outputting an image having substantially the same hue as that of the subject, based on the colorimetry signals.

The input conversion means comprises, for example, a scanner for scanning a film to read the image, to convert the image to RGB image signals corresponding to the image.

The demodulation means can be carried out, for example, by the following steps.

First, the projected-image signals are converted to the integral density of the subject, by referring to a conversion table determined previously using wedge for the proof or the like. Then, the analyzed density is converted to the exposure density based on the characteristic curve of the film, and using it the prescribed exponent operation is carried out, to find the exposure transmittance. Finally, the exposure transmittance is subjected to a prescribed 3-row 3-column matrix operation, to reproduce the colorimetry information of the subject. This colorimetry information is a so-called appearance value scanner, and it faithfully represents the hue of the subject.

Further, when the analyzed density is converted to the exposure density, the demodulation means uses correspondence information (e.g. a table or an operation formula) of the analyzed density and the exposure density previously stored in a memory means. Herein, it is also possible that, from a reference image recorded previously in a prescribed region outside the photographing image area of the color film, a reference density is found, and based on the exposure density of the reference image, the misalignment (deviation) of the correspondency among the correspondence information of the memory means, the analyzed density of the film to be processed, and the exposure density, is corrected. By carrying out such processing, the color of the subject can be reproduced faithfully, even if there are changes in the color film before and after the processing, such as changes in performance of the unexposed film, for example, due to temperature and humidity; processing fluctuations; changes in the processed image (e.g. fading); scatter of the light-sensitive material when it is produced, and the like.

The output means is composed, for example, of a display device, a color printer, and the like. The output means corrects aesthetically, if required, the colorimetry signals from the demodulation means, and then it converts to colorimetry signals based on the three primary colors (e.g. colors of RGB fluorescent substances of a color CRT) for use in the image display by a 3-row 3-column matrix operation, to display the image in accordance with the colorimetry signals. Further, the colorimetry signals are subjected to logarithmic conversion, and the resulting colorimetry signals converted are subjected to a prescribed 3-row 3-column matrix operation, to obtain coloring material signals representing the density of the coloring material, to form the image on a medium by a color printer.

An image processing system and an image processing method, as described in JP-A No. 139323/1994 are specific examples preferably used for the present invention.

In this case, preferably the difference between the maximum density and the minimum density of the color film is 1.5 or less. To obtain a finished print with a high image quality, it is necessary to use a photoelectric conversion element high in both space resolution and density (quantity of light) resolution, and, for example, a CCD sensor or the like is favorably used. However, generally in the case of a photoelectric conversion element excellent both in space resolution and density resolution, the density range (dynamic range) that can be measured is narrow, and it is difficult to measure all the density range of color negative films usually used at the present time. By letting the difference between the maximum density and the minimum density be 1.5 or less, it is possible to increase the S/N ratio when the image density of the film is read out by an input conversion means, such as a CCD or a scanner. Preferably the interlayer effect of the color film is as small as possible. This is because the structure of the film becomes simple and the latter step of processing the images becomes simple and accurate. More specifically, the smaller the usage of DIR couplers that increase the interlayer effect is, the more preferable it is.

In the silver halide photographic emulsion of the present invention, by forming part or the whole of each of specified silver halide tabular grains into a mixed crystal region containing 0.01 mol % or more of different halide ions, the dislocation in the grains can be fixed, to allow the dislocation in the grains to remain even during the growth process and the post-ripening process.

Therefore, according to the present invention, it is possible to prevent the dislocation, which is considered to be the driving force for anisotropic growth in the production of {100} tabular grains, from disappearing, to manufacture highly monodisperse tabular grains having a higher aspect ratio. Further, according to the present invention, the sensitivity can be increased by the dislocation that has been allowed intentionally to remain in the final tabular grains after the post-ripening.

Further, according to the present invention, a silver halide color photographic light-sensitive material that is excellent in rapid processibility and that exhibits photographic properties high in sensitivity and excellent in graininess and process stability, can be provided.

EXAMPLES

Now, the present invention is described in more detail with reference to the following examples, but the present invention is not limited to these.

Comparative Example 1

Preparation of {100} AgCl tabular emulsion (Br conversion type)

1582 ml of an aqueous gelatin solution (containing 19.5 g of gelatin-1 (deionized alkali-processed bone gelatin having a methionine content of about 40 μmol/g) and 7.8 ml of a 1N $HNO_3$ solution; pH 4.3) and 13 ml of NaCl-1 solution (containing 10 g of NaCl in 100 ml), were placed in a reaction vessel, and 15.6 ml of Ag-1 solution (containing 20 g of $AgNO_3$ in 100 ml) and 15.6 ml of X-1 solution (containing 7.05 g of NaCl in 100 ml) were added, at a rate of 62.4 ml/min, in a double jet manner, with the temperature kept at 40° C. After 3 min of stirring, 28.2 ml of X-2 solution (containing 1.1 g of KBr in 100 ml) was mixed in, at a rate of 80.6 ml/min, in a double jet manner. After 3 min of stirring, 46.8 ml of Ag-1 solution and 46.8 ml of X-1 solution were added, at a rate of 62.4 ml/min, in a double jet manner. After 2 min of stirring, 203 ml of an aqueous gelatin solution (containing 13 g of gelatin-1, 1.3 g of NaCl, and a 1N NaOH solution necessary to adjust pH to 6.5) was added, to bring the electric potential to 80 mV, and the temperature was elevated to 75° C., to adjust the electric potential to 100 mV, followed by ripening for 3 min. Thereafter, Ag-2 solution (containing 50 g of $AgNO_3$ in 100 ml) and X-3 solution (containing 17.6 g of NaCl in 100 ml) were added, at a constant flow rate, by the C.D.J. (controlled double jet) method, for 41 min, with 140 mV being kept until the added amount of Ag-2 solution reached 375 ml. Then, AgBr fine grains having an average sphere-equivalent diameter (an average diameter of spheres which grains are assumed to be) of 0.03 μm were added, in an amount equivalent to 0.2 mol % per mol of the silver halide, followed by ripening for about 5 min, to complete the halogen conversion. A settling agent was added, and the temperature was lowered to 35° C., followed by settling and washing with water. An aqueous gelatin solution was added, and the pH was adjusted to 6.0, at 60° C. The TEM image of a replica of the grains was observed. The obtained emulsion was silver chloride {100} tabular grains containing 99.5 mol % of AgCl based on silver.

Preparation of emulsion A (grown part complete Br mixed crystal type I) of the present invention 1582 ml of an aqueous gelatin solution (containing 19.5 g of gelatin-1 (deionized alkali-processed bone gelatin having a methionine content of about 40 μmol/g) and 7.8 ml of a 1N $HNO_3$ solution; pH 4.3) and 13 ml of NaCl-1 solution (containing 10 g of NaCl in 100 ml), were placed in a reaction vessel, and 15.6 ml of Ag-1 solution (containing 20 g of $AgNO_3$ in 100 ml) and 15.6 ml of X-1 solution (containing 7.05 g of NaCl in 100 ml) were added, at a rate of 62.4 ml/min, in a double jet manner, with the temperature kept at 40° C. After 3 min of stirring, 28.2 ml of X-2 solution (containing 1.1 g of KBr in 100 ml) was mixed in, at a rate of 80.6 ml/min, in a double jet manner. After 3 min of stirring, 46.8 ml of Ag-1 solution and 46.8 ml of X-1 solution were added, at a rate of 62.4 ml/min, in a double jet manner. After 2 min of stirring, 203 ml of an aqueous gelatin solution (containing 13 g of gelatin-1, 1.3 g of NaCl, and a 1N NaOH solution necessary to adjust pH to 6.5) was added, to bring the pCl to 1.75, and the temperature was elevated to 65° C., to adjust the pCl to 1.95, followed by ripening for 3 min. Thereafter, Ag-2 solution (containing 50 g of $AgNO_3$ in 100 ml) and X-4 solution (containing 16.4 g of NaCl and 2.5 g of KBr in 100 ml) were added, at a constant flow rate, by the C.D.J. (controlled double jet) method, for 20 min, until the added amount of Ag-2 solution reached 182 ml. Then, AgBr fine grains having an average sphere-equivalent diameter of 0.03 μm were added, in an amount equivalent to 0.2 mol % per mol of the silver halide, followed by ripening for about 5 min, to complete the halogen conversion. A settling agent was added, and the temperature was lowered to 35° C., followed by settling and washing with water. An aqueous gelatin solution was added, and the pH was adjusted to 6.0, at 60° C. The TEM image of a replica of the grains was observed. The obtained emulsion was silver chlorobromide {100} tabular grains containing 6.95 mol % of AgBr based on silver.

Preparation of emulsion B (grown part complete Br mixed crystal type II) of the present invention Emulsion B was prepared in the same manner as in the emulsion A of the present invention, except that, instead of X-4 solution, X-5 solution (containing 17.2 g of NaCl and 0.9 g of KBr in 100 ml) was added. The TEM image of a replica of the grains was observed. The obtained emulsion was silver chlorobromide {100} tabular grains containing 2.45 mol % of AgBr based on silver.

Preparation of emulsion C (grown part partial Br mixed crystal type) of the present invention Emulsion C was prepared in the same manner as in the emulsion A of the present invention, except that, instead of only X-4 solution, X-4 solution (containing 16.9 g of NaCl and 2.5 g of KBr in 100 ml) was added, by the C.D.J. (controlled double jet) method, at a constant flow rate, for 7 min, until the added amount of X-4 solution reached 60 ml, and then after 5 min, Ag-2 solution (containing 50 g of $AgNO_3$ in 100 ml) and X-3 solution (containing 17.6 g of NaCl in 100 ml) were added, by the C.D.J. (controlled double jet) method, for 13 min, at a constant flow rate, until the added amount of Ag-2 solution reached 122 ml. The TEM image of a replica of the grains was observed. The obtained emulsion was silver chlorobromide {100} tabular grains containing 4.95 mol % of AgBr based on silver.

Preparation of emulsion D (nucleus Br mixed crystal type I) of the present invention 1582 ml of an aqueous gelatin solution (containing 19.5 g of gelatin-1 (deionized alkali-processed bone gelatin having a methionine content of about 40 μmol/g) and 7.8 ml of a 1N $HNO_3$ solution; pH 4.3) and 13 ml of NaCl-1 solution (containing 10 g of NaCl in 100 ml), were placed in a reaction vessel, and 15.6 ml of Ag-1 solution (containing 20 g of $AgNO_3$ in 100 ml) and 15.6 ml of X-1 solution (containing 7.05 g of NaCl in 100 ml) were added, at a rate of 62.4 ml/min, in a double jet manner, with the temperature kept at 40° C. After 3 min of stirring, 28.2 ml of X-2 solution (containing 1.1 g of KBr in 100 ml) was mixed in, at a rate of 80.6 ml/min, in a double jet manner. After 3 min of stirring, 46.8 ml of Ag-1 solution and 46.8 ml of X-6 solution (containing 6.67 g of NaCl and 0.72 g of KBr in 100 ml) were added, at a rate of 62.4 ml/min, in a double jet manner. After 2 min of stirring, 203 ml of an aqueous gelatin solution (containing 13 g of gelatin-1, 1.3 g of NaCl, and a 1N NaOH solution necessary to adjust pH to 6.5) was added, to bring the pCl to 1.75, and the temperature was elevated to 65° C., to adjust the pCl to 1.95, followed by ripening for 3 min. Thereafter, Ag-2 solution (containing 50 g of $AgNO_3$ in 100 ml) and X-3 solution (containing 17.6 g of NaCl in 100 ml) were added, at a constant flow rate, by the C.D.J. (controlled double jet) method, for 20 min, until the added amount of Ag-2 solution reached 182 ml. Then, AgBr fine grains having an average sphere-equivalent diameter of 0.03 μm were added, in an amount equivalent to 0.2 mol % per mol of the silver halide, followed by ripening for about 5 min, to complete the halogen conversion. A settling agent was added, and the temperature was lowered to 35° C., followed by settling and washing with water. An aqueous gelatin solution was added, and the pH was adjusted to 6.0, at 60° C. The TEM image of a replica of the grains was observed. The obtained emulsion was silver chlorobromide {100} tabular grains containing 0.5 mol % of AgBr based on silver.

Preparation of emulsion E (nucleus Br mixed crystal type II) of the present invention 1582 ml of an aqueous gelatin solution (containing 19.5 g of gelatin-1 (deionized alkali-processed bone gelatin having a methionine content of about 40 μmol/g) and 7.8 ml of a 1N $HNO_3$ solution; pH 4.3) and 13 ml of NaCl-1 solution (containing 10 g of NaCl in 100 ml), were placed in a reaction vessel, and 15.6 ml of Ag-1 solution (containing 20 g of $AgNO_3$ in 100 ml) and 15.6 ml of X-6 solution (containing 6.67 g of NaCl and 0.72 g of KBr in 100 ml) were added, at a rate of 62.4 ml/min, in a double jet manner, with the temperature kept at 40° C. After 3 min of stirring, 28.2 ml of X-2 solution (containing 1.1 g of KBr in 100 ml) was mixed in, at a rate of 80.6 ml/min, in a double jet manner. After 3 min of stirring, 46.8 ml of Ag-1 solution and 46.8 ml of X-6 solution were added, at a rate of 62.4 ml/min, in a double jet manner. After 2 min of stirring, 203 ml of an aqueous gelatin solution (containing 13 g of gelatin-1, 1.3 g of NaCl, and a 1N NaOH solution necessary to adjust ah to 6.5) was added, to bring the pCl to 1.75, and the temperature was elevated to 65° C., to adjust the pCl to 1.95, followed by ripening for 3 min. Thereafter, Ag-2 solution (containing 50 g of $AgNO_3$ in 100 ml) and X-3 solution (containing 17.6 g of NaCl in 100 ml) were added, at a constant flow rate, by the C.D.J. (controlled double jet) method, for 20 min, until the added amount of Ag-2 solution reached 182 ml. Then, AgBr fine grains having an average sphere-equivalent diameter of 0.03 μm were added, in an amount equivalent to 0.2 mol % per mol of the silver halide, followed by ripening for about 5 min, to complete the halogen conversion. A settling agent was added, and the temperature was lowered to 35° C., followed by settling and washing with water. An aqueous gelatin solution was added, and the pH was adjusted to 6.0, at 60° C. The TEM image of a replica of the grains was observed. The obtained emulsion was silver chlorobromide {100} tabular grains containing 0.63 mol % of AgBr based on silver.

Figure 2:
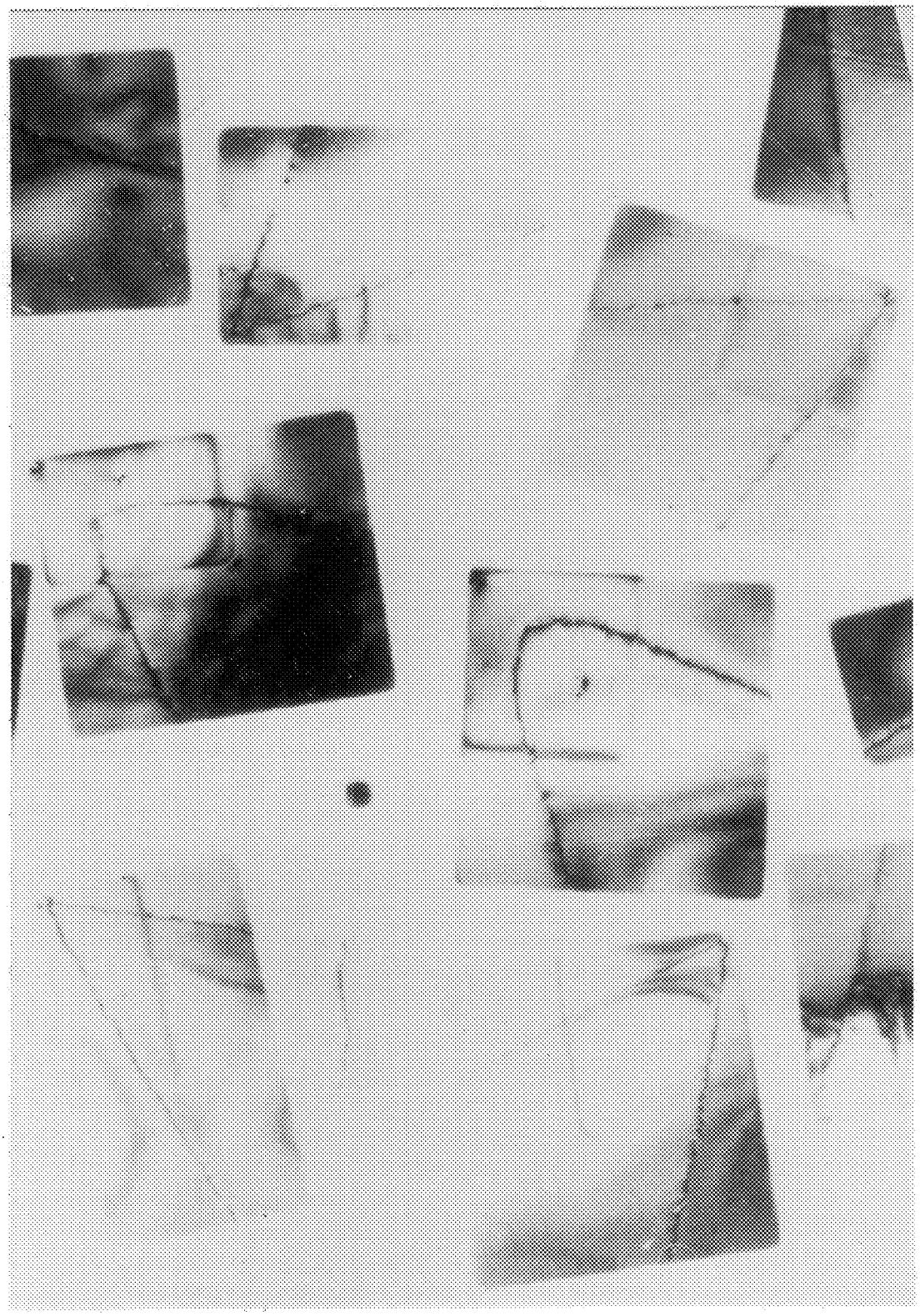
FIG. 2 is a photograph of the observed dislocation lines taken under a transmission electron microscope, showing the crystal structure of grains of Emulsion (F) of the present invention.

Preparation of emulsion F (nucleus Br mixed crystal type II+grown part complete Br mixed crystal type I) of the present invention Emulsion F was prepared in the same manner as in the emulsion E of the present invention, except that, instead of X-3 solution, X-4 solution (containing 16.4 g of NaCl and 2.5 g of KBr in 100 ml) was added. The TEM image of a replica of the grains was observed. A photomicrography with a shadow of a carbon particle replica of the resulting emulsion grains is shown in FIG. 1, and a photograph of the observed dislocation lines taken under a transmission-type electron microscope is shown in FIG. 2. The obtained emulsion was silver chlorobromide {100} tabular grains containing 7.10 mol % of AgBr based on silver.

Preparation of emulsion G (nucleus Br mixed crystal type II+grown part partially Br mixed crystal type) of the present invention Emulsion G was prepared in the same manner as in the emulsion E of the present invention, except that, instead of only X-3 solution, X-4 solution (containing 16.9 g of NaCl and 2.5 g of KBr in 100 ml) was added, by the C.D.J. (controlled double jet) method, at a constant flow rate, for 7 min, until the added amount of X-4 solution reached 60 ml, and then after 5 min, Ag-2 solution (containing 50 g of $AgNO_3$ in 100 ml) and X-3 solution (containing 17.6 g of NaCl in 100 ml) were added, by the C.D.J. (controlled double jet) method, for 13 min, at a constant flow rate, until Ag-2 solution reached 122 ml. The TEM image of a replica of the grains was observed. The obtained emulsion was silver chlorobromide {100} tabular grains containing 5.10 mol % of AgBr based on silver.

Preparation of emulsions A' (grown part complete I mixed crystal type I) and C' (grown part partially I mixed crystal type) of the present invention Emulsions A' and C' were prepared in the same manners as in the emulsions A and C of the present invention, except that, instead of X-4 solution, X-4' solution (containing 17.5 g of NaCl and 0.05 g of KI in 100 ml) was added. The TEM images of replicas of the grains were observed. The obtained emulsions A' and C' were silver chloroiodobromide {100} tabular grains containing 0.1 mol % and 0.045 mol %, respectively, of AgI based on silver.

Preparation of emulsion B' (grown part complete I mixed crystal type II) of the present invention Emulsion B' was prepared in the same manner as in the emulsion B of the present invention, except that, instead of X-5 solution, X-5' solution (containing 17.6 g of NaCl and 0.0005 g of KI in 100 ml) was added. The TEM image of a replica of the grains was observed. The obtained emulsion was silver chloroiodobromide {100} tabular grains containing 0.001 mol % of AgI based on silver.

Comparative Example 2

Preparation of {100} AgBr tabular emulsion

An aqueous gelatin solution (1200 ml of $H_2O$, 24 g of deionized alkali-processed bone gelatin, 3.8 ml of NaOH (1N), and 30 ml of NaCl (1%)) was placed in a reaction vessel, and the temperature was kept at 40° C. An Ag-4 aqueous solution (containing 4.88 g of $AgNO_3$ in 100 ml), and an X-8 aqueous solution (containing 0.17 g of NaCl in 100 ml) whose molar concentration was equivalent to that of the Ag-4 aqueous solution, were added, at a rate of 20 ml/min, for 24 sec, in a double jet manner, with stirring. After 3 min of stirring, an Ag-1 aqueous solution (containing 20 g of $AgNO_3$ in 100 ml), and an X-9 aqueous solution (containing 14 g of KBr in 100 ml) whose molar concentration was equivalent to that of the Ag-1 aqueous solution, were added, at a rate of 48 ml/min, for 1 min, in a double jet manner. Further, using an $AgNO_3$ solution (containing 20 g of $AgNO_3$ in 100 ml), the silver electric potential was adjusted to +150 mV. Then the temperature was elevated to 60° C. over 10 min, followed by ripening for 15 min. Thereafter, an AgBr fine-grain emulsion (having an average grain diameter of 0.1 $\mu$m) was added, at a fine-grain addition rate of $2.68\times10^{-2}$ mol/min, for 20 min. A settling agent was added, and the temperature was lowered to 35° C., followed by settling and washing with water. An aqueous gelatin solution was added, and the pH was adjusted to 6.0, at 60° C. The TEM image of a replica of the grains was observed. The obtained emulsion was silver bromide {100} tabular grains containing 99.5 mol % of AgBr based on silver.

Preparation of emulsion D' ({100} grown part Cl mixed crystal AgBr tabular emulsion) of the present invention An aqueous gelatin solution (1200 ml of $H_2O$, 24 g of deionized alkali-processed bone gelatin, 3.8 ml of NaOH (1N), and 30 ml of NaCl (1%)) was placed in a reaction vessel, and the temperature was kept at 40° C. An Ag-4 aqueous solution (containing 4.88 g of $AgNO_3$ in 100 ml), and an X-8 aqueous solution (containing 0.17 g of NaCl in 100 ml) whose molar concentration was equivalent to that of the Ag-4 aqueous solution, were added, at a rate of 20 ml/min, for 24 sec, in a double jet manner, with stirring. After 3 min of stirring, an Ag-1 aqueous solution (containing 20 g of $AgNO_3$ in 100 ml), and an X-9 aqueous solution (containing 14 g of KBr in 100 ml) whose molar concentration was equivalent to that of the Ag-1 aqueous solution, were added, at a rate of 48 ml/min, for 1 min, in a double jet manner. Further, using an $AgNO_3$ solution (containing 20 g of $AgNO_3$ in 100 ml), the silver electric potential was adjusted to +150 mV. Then the temperature was elevated to 60° C. over 10 min, followed by ripening for 15 min. Thereafter, an AgBrCl fine-grain emulsion (having an average grain diameter of 0.1 $\mu$m and a Cl content of 15 mol %) was added, at a fine-grain addition rate of $2.68\times10^{-2}$ mol/min, for 20 min, A settling agent was added, and the temperature was lowered to 35° C., followed by settling and washing with water. An aqueous gelatin solution was added, and the pH was adjusted to 6.0, at 60° C. The TEM image of a replica of the grains was observed. The obtained emulsion was silver chlorobromide {100} tabular grains containing 11.2 mol % of AgCl based on silver.

Preparation of emulsion E' ({100} grown part I mixed crystal AgBr tabular emulsion) of the present invention Emulsion E' was prepared in the same manner as in the emulsion D' of the present invention, except that, instead of AgBrCl fine-grains, AgBrI fine grains (having an average grain diameter of 0.1 $\mu$m and an I content of 0.01 mol %) was added. The TEM image of a replica of the grains was observed. The obtained emulsion was silver iodobromide {100} tabular grains containing 0.01 mol % of AgI based on silver.

Comparative Example 3

Preparation of {100} AgCl tabular emulsion (I conversion type)

1582 ml of an aqueous gelatin solution (containing 19.5 g of gelatin-1 (deionized alkali-processed bone gelatin having a methionine content of about 40 $\mu$mol/g) and 7.8 ml of a 1N $HNO_3$ solution; pH 4.3) and 13 ml of NaCl-1 solution (containing 10 g of NaCl in 100 ml), were placed in a reaction vessel, and 15.6 ml of Ag-1 solution (containing 20 g of $AgNO_3$ in 100 ml) and 15.6 ml of X-1 solution (containing 7.05 g of NaCl in 100 ml) were added, at a rate of 62.4 ml/min, in a double jet manner, with the temperature kept at 40° C. After 3 min of stirring, 28.2 ml of X-2' solution (containing 1.5 g of KI in 100 ml) was mixed in, at a rate of 80.6 ml/min, in a double jet manner. After 3 min of stirring, 46.8 ml of Ag-1 solution and 46.8 ml of X-1 solution were added, at a rate of 62.4 ml/min, in a double jet manner. After 2 min of stirring, 203 ml of an aqueous gelatin solution (containing 13 g of gelatin-1, 1.3 g of NaCl, and a 1N NaOH solution necessary to adjust pH to 6.5) was added, to bring the electric potential to 80 mV, and the temperature was elevated to 75° C., to adjust the electric potential to 100 mV, followed by ripening for 3 min. Thereafter, Ag-2 solution (containing 50 g of $AgNO_3$ in 100 ml) and X-3 solution (containing 17.6 g of NaCl in 100 ml) were added, at a constant flow rate, by the C.D.J. (controlled double jet) method, for 41 min, with 140 mV being kept until the added amount of Ag-2 solution reached 375 ml. Then, AgBr fine-grains having an average sphere-equivalent diameter of 0.03 $\mu$m were added, in an amount equivalent to 0.2 mol % per mol of the silver halide, followed by ripening for about 5 min, to complete the halogen conversion. A settling agent was added, and the temperature was lowered to 35° C., followed by settling and washing with water. An aqueous gelatin solution was added, and the pH was adjusted to 6.0, at 60° C. The TEM image of a replica of the grains was observed. The obtained emulsion was silver chloroiodide {100} tabular grains containing 99.5 mol % of AgCl based on silver.

Comparative Example 4

Preparation of {100} AgCl tabular emulsion (I conversion type×grown part complete Br mixed crystal type I)

1582 ml of an aqueous gelatin solution (containing 19.5 g of gelatin-1 (deionized alkali-processed bone gelatin having a methionine content of about 40 $\mu$mol/g) and 7.8 ml of a 1N $HNO_3$ solution; pH 4.3) and 13 ml of NaCl-1 solution (containing 10 g of NaCl in 100 ml), were placed in a reaction vessel, and 15.6 ml of Ag-1 solution (containing 20 g of $AgNO_3$ in 100 ml) and 15.6 ml of X-1 solution (containing 7.05 g of NaCl in 100 ml) were added at a rate of 62.4 ml/min, in a double jet manner, with the temperature kept at 40° C. After 3 min of stirring, 28.2 ml of X-2 solution (containing 1.5 g of KI in 100 ml) was mixed in, at a rate of 80.6 ml/min in a double jet manner. After 3 min of stirring, 46.8 ml of Ag-1 solution and 46.8 ml of X-1 solution were added, at a rate of 62.4 ml/min, in a double jet manner. After 2 min of stirring, 203 ml of an aqueous gelatin solution (containing 13 g of gelatin-1, 1.3 g of NaCl, and a 1N NaOH solution necessary to adjust pH to 6.5) was added, to bring the pCl to 1.75, and the temperature was elevated to 65° C., to adjust the pCl to 1.95, followed by ripening for 3 min. Thereafter, Ag-2 solution (containing 50 g of $AgNO_3$ in 100 ml) and X-4 solution (containing 16.4 g of NaCl and 2.5 g of KBr in 100 ml) were added, at a constant flow rate, by the C.D.J. (controlled double jet) method, for 20 min, until the added amount of Ag-2 solution reached 182 ml. Then, AgBr fine-grains having an average sphere-equivalent diameter of 0.03 $\mu$m were added, in an amount equivalent to 0.2 mol % per mol of the silver halide, followed by ripening for about 5 min, to complete the halogen conversion. A settling agent was added, and the temperature was lowered to 35° C., followed by settling and washing with water. An aqueous gelatin solution was added, and the pH was adjusted to 6.0, at 60° C. The TEM image of a replica of the grains was observed. The obtained emulsion was silver chloroiodobromide {100} tabular grains containing 6.95 mol % of AgBr based on silver.

These emulsions were subjected to gold-sulfur-selenium sensitization, as follows.

The emulsions were heated to 57° C.; the below-mentioned sensitizing dyes ExS-1, ExS-2, and ExS-3 were added, in such amounts and rates that desired spectral sensitivities would be obtained; then AgBr fine grains having an average sphere-equivalent diameter of 0.03 $\mu$m were added, in an amount equivalent to 0.2 mol % per mol of the silver halide, and ripening was carried out for about 5 min, to complete the halogen conversion. Then, sodium thiosulfate, in an amount of $4.6\times10^{-6}$ mol/mol of Ag; chloroauric acid, in an amount of $2.7\times10^{-6}$ mol/mol of Ag; potassium thiocyanate, in an amount of $1.8\times10^{-3}$ mol/mol of Ag; and N,N-dimethylselenourea, in an amount of $1.1\times10^{-6}$ mol/mol of Ag, were added, to carry out optimum chemical sensitization.

The results of the observation by direct TEM of dislocation lines on the principal planes of the Comparative Examples 1 to 4 and the emulsions A to E' of the present invention after post-ripening, are shown in Table 1.

In passing, the parameters T, T0, T1, T2, and T3 shown in Table 1 are defined as follows:

T=(number of tabular grains in which dislocation was observed on principal planes/number of all tabular grains)×100

T0=(number of tabular grains in which one point of contact with a dislocation line was observed on each of two adjacent sides of the principal plane/number of all tabular grains)×100

T1=(number of tabular grains in which one point of contact with a dislocation line was observed on each of two adjacent sides of the principal plane, and one or two dislocation lines starting from only one corner not adjacent to said two sides were observed/number of all tabular grains)×100

T2=(number of tabular grains in which a dislocation line was not contact with any corners of the principal plane, and one point of contact with a dislocation line was observed on each of two adjacent sides of the principal plane/number of all tabular grains)×100

T3=(number of tabular grains in which one dislocation line starting from one corner of the principal plane was observed/number of all tabular grains)×100

Herein "number of all tabular grains" refers to {100} tabular grains having an aspect ratio of 2 or over, but 25 or below.

The number of all tabular grains in each of the emulsions of Comparative Examples and the emulsions A to E' of the present invention accounted for over 90% of the sum of projected areas of all AgX grains.

TABLE 1

| Emulsion | T | T0 | T1 | T2 | T3 |
|---|---|---|---|---|---|
| Comparative Example 1 | 39 | 26 | 10 | 14 | 10 |
| Comparative Example 2 | 38 | 25 | 10 | 12 | 12 |
| Emulsion A of the present invention | 82 | 78 | 39 | 35 | 5 |
| Emulsion B of the present invention | 79 | 76 | 35 | 40 | 6 |
| Emulsion C of the present invention | 75 | 68 | 34 | 30 | 7 |
| Emulsion D of the present invention | 80 | 78 | 55 | 22 | 2 |
| Emulsion E of the present invention | 82 | 77 | 50 | 25 | 2 |
| Emulsion F of the present invention | 91 | 88 | 75 | 11 | 3 |
| Emulsion G of the present invention | 90 | 85 | 71 | 12 | 4 |
| Emulsion A' of the present invention | 80 | 74 | 45 | 28 | 6 |
| Emulsion B' of the present invention | 76 | 70 | 48 | 21 | 4 |
| Emulsion C' of the present invention | 77 | 72 | 46 | 24 | 4 |
| Emulsion D' of the present invention | 74 | 65 | 44 | 19 | 9 |
| Emulsion E' of the present invention | 76 | 70 | 48 | 21 | 4 |
| Comparative Example 3 | 15 | 10 | 1 | 5 | 3 |
| Comparative Example 4 | 45 | 29 | 2 | 14 | 5 |

As is apparent from the results shown in Table 1, it can be understood that, in comparison with the Comparative Examples, in the case of the emulsions of the present invention, even after the post-ripening, considerable proportions of the dislocation lines were retained on the principal planes. This is due to the effect of the emulsions of the present invention, in which the mixed crystal regions containing different halides occupied part or all of the tabular grains.

Further, it can also be understood that the rate (T0) of tabular grains in which one point of contact with a dislocation line was observed on each of two adjacent sides of the principal plane, was 30% or less in the case of the emulsions of Comparative Examples, while 65% or more in the case of all the emulsions of the present invention.

Further, in contrast to the emulsions A to C and A' to E' of the present invention, in which mixed crystal regions were provided in the grown parts, in the case of the emulsions D to G of the present invention, wherein the nuclei were composed of mixed crystals, it can be understood that the rate (T1) of tabular grains wherein one point of contact with a dislocation line was observed on each of two adjacent sides of the principal plane, and one or two dislocation lines starting from only one corner not adjacent to said two sides were observed, was 50% or more. The assumed explanation for this is that, in the case of the emulsions A to C and A' to E' of the present invention, in which mixed crystal regions were provided only in the grown parts, the dislocation lines present in the nuclei moved during the growth or the post-ripening, while in the case of the emulsions D to G of the present invention, in which the nuclei were composed of mixed crystals, the dislocation lines present in the nuclei were retained after the post-ripening, to cause a difference in distribution of T1 and T2.

The shape properties of these emulsions are shown in Table 2.

TABLE 2

| Emulsion | Average aspect ratio | Average thickness (μm) | Deviation coefficient | Side ratio |
|---|---|---|---|---|
| Comparative Example 1 | 6.7 | 0.18 | 0.37 | 2.10 |
| Emulsion A of the present invention | 12.1 | 0.12 | 0.24 | 1.25 |
| Emulsion B of the present invention | 11.0 | 0.13 | 0.25 | 1.30 |
| Emulsion C of the present invention | 12.0 | 0.12 | 0.24 | 1.25 |
| Emulsion D of the present invention | 10.8 | 0.14 | 0.27 | 1.33 |
| Emulsion E of the present invention | 12.0 | 0.12 | 0.23 | 1.25 |
| Emulsion F of the present invention | 12.5 | 0.11 | 0.23 | 1.25 |
| Emulsion G of the present invention | 12.0 | 0.12 | 0.24 | 1.25 |
| Emulsion A' of the present invention | 12.0 | 0.12 | 0.25 | 1.40 |
| Emulsion B' of the present invention | 11.0 | 0.13 | 0.25 | 1.35 |
| Emulsion C' of the present invention | 12.0 | 0.12 | 0.24 | 1.45 |
| Comparative Example 2 | 6.4 | 0.20 | 0.38 | 2.15 |
| Present emulsion D' present invention | 10.5 | 0.14 | 0.25 | 1.30 |
| Present emulsion E' present invention | 11.0 | 0.13 | 0.25 | 1.35 |
| Comparative Example 3 | 6.9 | 0.17 | 0.39 | 2.30 |
| Comparative Example 4 | 10.0 | 0.14 | 0.45 | 2.45 |

As is apparent from the results shown in Table 2, it can be understood that the average thickness of the emulsions A to E' of the present invention was 0.14 μm or less, which was thinner than that of Comparative Examples 1 and 2, showing that the anisotropic growth performance was excellent in emulsions of the present invention.

Further, in view of the deviation coefficient, it can be understood that the emulsions A to E' of the present invention were clearly excellent in monodispersibility in comparison with Comparative Examples 1 and 2.

Further, particularly since the side ratios of the emulsions A to G of the present invention were 1.33 or less, it can be understood that, with respect to the shape of the principal planes of the emulsions A to G of the present invention, nearly all of the tabular grains had approximately square shapes.

As is apparent from the results shown in Tables 1 and 2, it can be understood that the emulsions of the present invention, in which dislocation, which could be considered to be the driving force of anisotropic growth, was intentionally retained, exhibited excellent effects in grain shapes, including aspect ratio, monodispersibility, and side ratio.

On the other hand, in comparison with Comparative Example 3, Comparative Example 4, in which a different halide was added in the grown parts of Comparative Example 3 (I conversion type), had a thin average thickness, but it could not give excellent results in monodispersibility and side ratio.

Now, Examples of silver halide color light-sensitive materials in which use is made of the emulsion of the present invention are shown.

First, the following emulsions a1 to a6 of the present invention and emulsions a7 to a9 were prepared.

Emulsion a1 of the Present Invention 1582 ml of an aqueous solution containing 19.5 g of gelatin-1 (deionized alkali-processed bone gelatin containing 40 μmol of methionine per g of gelatin), 7.8 ml of $HNO_3$ (1N), and 1.3 g of NaCl, was placed in a reaction vessel, and 15.6 ml of Ag-1 solution (containing 20 g of $AgNO_3$ in 100 ml) and 15.6 ml of x-1 solution (containing 7.05 g of NaCl in 100 ml) were added, at a rate of 62.4 ml/min, in a double jet manner, with the temperature kept at 40° C. After 3 min of stirring, 28.2 ml of x-2 solution (containing 1.1 g of KBr in 100 ml) was added, at a rate of 80.6 ml/min. After 3 min of stirring, 46.8 ml of Ag-1 solution and 46.8 ml of x-1 solution were added, at a rate of 62.4 ml/min, in a double jet manner. After 2 min of stirring, 203 ml of an aqueous gelatin solution (containing 13 g of gelatin-1, 1.3 g of NaCl, and NaOH necessary to adjust pH to 6.5 was added, to bring the electric potential to 80 mV, and the temperature was elevated to 75° C., to adjust the electric potential to 100 mV, followed by ripening for 3 min. Thereafter, Ag-2 solution (containing 50 g of $AgNO_3$ in 100 ml) and x-3 solution (containing 16.9 g of NaCl and 1.4 g of KBr in 100 ml) were added, at a constant flow rate, by the C.D.J. (controlled double jet) method, for 41 min, with 140 mV being kept, until the added amount of Ag-2 solution reached 375 ml.

Then, a settling agent was added, and after a usual desalting process was carried out, an aqueous gelatin solution was added, for redispersion. At 38° C., the pH was adjusted to 6.2, and the silver electric potential was adjusted to 80 mV.

The thus prepared silver halide emulsion was composed of silver chlorobromide grains that had an average sphere-equivalent diameter of 0.87 μm, that had an average silver chloride content of 97.8 mol %, and that had an aspect ratio of 7.6; and 70% of the total projected area of the grains in the emulsion was attributed to grains in which the side ratio of adjacent sides of the principal plane was 2 or less.

The emulsion was chemically sensitized as follows.

The emulsion was heated to 57° C., and then the below-mentioned sensitizing dyes ExS-4, ExS-5, and ExS-6 were added, in amounts of $3.7\times10^{-5}$ mol/mol of Ag, $8.1\times10^{-5}$ mol/mol of Ag, and $3.2\times10^{-4}$ mol/mol of Ag, respectively, and then AgBr fine grains having an average sphere-equivalent diameter of 0.05 μm were added, in an amount equivalent to 0.2 mol % per mol of the silver halide, and after ripening was carried out for about 5 min, sodium thiosulfate, in an amount of $4.6\times10^{-6}$ mol/mol of Ag, potassium thiocyanate, in an amount of $1.8\times10^{-3}$ mol/mol of Ag, and N,N-dimethylselenourea, in an amount of $1\times10^{-6}$ mol/mol of Ag, were added, to carry out optimum chemical sensitization. Immediately before the completion of the chemical sensitization, 1-(3-acetamidophenyl)-5-mercaptotetrazole was added, in an amount of $7\times10^{-4}$ mol/mol of Ag.

Emulsion a2 of the Present Invention

Emulsion a2 was prepared in the same manner as in the emulsion al of the present invention, except that the added amounts of the sensitizing dyes ExS-1, ExS-2, and ExS-3 in the chemical sensitization process were changed to $2.4\times10^{-4}$ mol/mol of Ag, $1.0\times10^{-4}$ mol/mol of Ag, and $3.4\times10^{-4}$ mol/mol of Ag, respectively.

Emulsion a3 of the Present Invention 1582 ml of an aqueous solution containing 19.5 g of gelatin-1 (deionized alkali-processed bone gelatin containing 40 μmol per g of gelatin), 7.8 ml of $HNO_3$ (1N), and 1.3 g of NaCl, was placed in a reaction vessel, and 15.6 ml of Ag-1 solution (containing 20 g of $AgNO_3$ in 100 ml) and 15.6 ml of x-1 solution (containing 7.05 g of NaCl in 100 ml) were added, at a rate of 62.4 ml/min, in a double jet manner, with the temperature kept at 40° C. After 3 min of stirring, 28.2 ml of x-2 solution (containing 1.1 g of KBr in 100 ml) was added, at a rate of 80.6 ml/min. After 3 min of stirring, 46.8 ml of Ag-1 solution and 46.8 ml of x-1 solution were added, at a rate of 62.4 ml/min, in a double jet manner. After 2 min of stirring, 203 ml of an aqueous gelatin solution (containing 13 g of gelatin-1, 1.3 g of NaCl, and NaOH necessary to adjust pH to 6.5) was added, to bring the electric potential to 80 mV, and the temperature was elevated to 75° C., to adjust the electric potential to 100 mV, followed by ripening for 3 min. Thereafter, 375 ml of Ag-2 solution (containing 50 g of $AgNO_3$ in 100 ml) was added at a rate of 4.63 ml/min, at the same time x-4 solution (containing 10.5 g of KBr in 121.5 ml) was added, with the flow rate that was increased by 0.037 ml per every minute from the initial flow rate of 0 ml/min, and at the same time x-3 solution (containing 16.9 g of NaCl and 1.4 g of KBr in 100 ml) was added, at such a flow rate that the electrical potential would be kept at 140 mV.

Then, a settling agent was added, and after a usual desalting process was carried out, an aqueous gelatin solution was added, for redispersion. At 38° C., the pH was adjusted to 6.2, and the silver electric potential was adjusted to 80 mV.

The thus prepared silver halide emulsion was composed of silver chlorobromide grains that had an average sphere-equivalent diameter of 1.25 μm, an average silver chloride content of 66 mol %, and an aspect ratio of 8.6; and 61% of the total projected area of the grains in the emulsion was attributed to grains in which the side ratio of adjacent sides of the principal plane was 2 or less.

The emulsion was chemically sensitized as follows.

The emulsion was heated to 57° C., and then the below-mentioned sensitizing dyes ExS-7 and ExS-8 were added, each in an amount of $2.5\times10^{-4}$ mol/mol of Ag, and then AgBr fine grains having an average sphere-equivalent diameter of 0.05 μm were added, in an amount equivalent to 0.2 mol % per mol of the silver halide, and after ripening was carried out for about 5 min, sodium thiosulfate, in an amount of $4.6\times10^{-6}$ mol/mol of Ag, potassium thiocyanate, in an amount of $1.6\times10^{-3}$ mol/mol of Ag, and N,N-dimethylselenourea, in an amount of $1\times10^{-6}$ mol/mol of Ag, were added, to carry out optimum chemical sensitization.

Emulsion a4 of the Present Invention 1582 ml of an aqueous solution containing 19.5 g of gelatin-1 (deionized alkali-processed bone gelatin containing 40 μmol per g of gelatin), 7.8 ml of $HNO_3$ (1N), and 1.3 g of NaCl, was placed in a reaction vessel, and 15.6 ml of Ag-1 solution (containing 20 g of $AgNO_3$ in 100 ml) and 15.6 ml of x-1 solution (containing 7.05 g of NaCl in 100 ml) were added, at a rate of 62.4 ml/min, in a double jet manner, with the temperature kept at 35° C. After 3 min of stirring, 28.2 ml of x-2 solution (containing 2.5 g of KBr in 100 ml) was added, at a rate of 80.6 ml/min. After 3 min of stirring, 46.8 ml of Ag-1 solution and 46.8 ml of x-1 solution were added at a rate of 62.4 ml/min in a double jet manner. After 2 min of stirring, 203 ml of an aqueous gelatin solution (containing 13 g of gelatin-1, 1.3 g of NaCl, and NaOH necessary to adjust pH to 6.5 was added, to bring the electric potential to 80 mV, and the temperature was elevated to 60° C., to adjust the electric potential to 100 mV, followed by ripening for 3 min. Thereafter, Ag-2 solution (containing 50 g of $AgNO_3$ in 100 ml) and x-3 solution (containing 16.9 g of NaCl and 1.4 g of KBr in 100 ml) were added, by the C.D.J. (controlled double jet) method, for 81 min, at a constant flow rate, with 140 mV being kept, until the added amount of Ag-2 solution reached 375 ml.

Then, a settling agent was added, and after a usual desalting process was carried out, an aqueous gelatin solution was added, for redispersion. At 38° C., the pH was adjusted to 6.2, and the silver electric potential was adjusted to 80 mV.

The thus prepared silver halide emulsion was composed of silver chlorobromide grains that had an average sphere-equivalent diameter of 0.60 μm, an average silver-chloride content of 97.8 mol %, and an aspect ratio of 6.6; and 70% of the total projected areas of the grains in the emulsion was attributed to grains in which the side ratio of adjacent sides of the principal plane was 2 or less.

The emulsion was chemically sensitized as follows.

The emulsion was heated to 57° C., and then the below-mentioned sensitizing dyes ExS-4, ExS-5 and ExS-6 were added, in amounts of $3.2\times10^{-5}$ mol/mol of Ag, $2.2\times10^{-4}$ mol/mol of Ag, and $8.4\times10^{-4}$ mol/mol of Ag, respectively, and then AgBr fine grains having an average sphere-equivalent diameter of 0.05 μm were added, in an amount equivalent to 0.2 mol % per mol of the silver halide, and after ripening was carried out for about 5 min, sodium thiosulfate, in an amount of $6.6\times10^{-6}$ mol/mol of Ag, potassium thiocyanate, in an amount of $2.3\times10^{-3}$ mol/mol of Ag, and N,N-dimethylselenourea, in an amount of $1\times10^{-6}$ mol/mol of Ag, were added, to carry out optimum chemical sensitization.

Emulsion a5 of the Present Invention

Emulsion a5 was prepared in the same manner as in the emulsion a4 of the present invention, except that the added amounts of the sensitizing dyes ExS-1, ExS-2, and ExS-3 in the chemical sensitization process were changed to $3.5\times10^{-4}$ mol/mol of Ag, $1.6\times10^{-5}$ mol/mol of Ag, and $5.1\times10^{-4}$ mol/mol of Ag, respectively.

Emulsion a6 of the Present Invention 1582 ml of an aqueous solution containing 19.5 g of gelatin-1 (deionized alkali-processed bone gelatin containing 40 μmol per g of gelatin), 7.8 ml of $HNO_3$ (1N), and 1.3 g of NaCl, was placed in a reaction vessel, and 15.6 ml of Ag-1 solution (containing 20 g of $AgNO_3$ in 100 ml) and 15.6 ml of x-1 solution (containing 7.05 g of NaCl in 100 ml) were added at a rate of 62.4 ml/min, in a double jet manner, with the temperature kept at 40° C. After 3 min of stirring, 28.2 ml of x-2 solution (containing 1.1 g of KBr in 100 ml) was added, at a rate of 80.6 ml/min. After 3 min of stirring, 46.8 ml of Ag-1 solution and 46.8 ml of x-1 solution were added, at a rate of 62.4 ml/min, in a double jet manner. After 2 min of stirring, 203 ml of an aqueous gelatin solution (containing 13 g of gelatin-1, 1.3 g of NaCl, and NaOH necessary to adjust pH to 6.5 was added, to bring the electric potential to 80 mV, and the temperature was elevated to 75° C., to adjust the electric potential to 100 mV, followed by ripening for 3 min. Thereafter, 375 ml of Ag-2 solution (containing 50 g of $AgNO_3$ in 100 ml) was added at a rate of 9.14 ml/min, at the same time x-4 solution (containing 10.5 g of KBr in 121.5 ml) was added, with the flow rate that was increased by 0.115 ml per every minute from the initial flow rate of 0 ml/min, and at the same time x-3 solution (containing 16.9 g of NaCl and 1.4 g of KBr in 100 ml) was added, at such a flow rate that the electrical potential would be kept at 140 mV.

Then, a settling agent was added, and after a usual desalting process was carried out, an aqueous gelatin solution was added, for redispersion. At 38° C., the pH was adjusted to 6.2 and the silver electric potential was adjusted to 80 mV.

The thus prepared silver halide emulsion was composed of silver chlorobromide grains that had an average sphere-equivalent diameter of 0.83 μm, an average silver-chloride content of 66 mol %, and an aspect ratio of 6.6; and 66% of the total projected areas of the grains in the emulsion was attributed to grains in which the side ratio of adjacent sides of the principal plane was 2 or less.

The emulsion was chemically sensitized as follows.

The emulsion was heated to 57° C., and then the below-mentioned sensitizing dyes ExS-7 and ExS-8 were added, each in an amount of $4.0\times10^{-4}$ mol/mol of Ag, and AgBr fine grains having an average sphere-equivalent diameter of 0.05 μm were added, in an amount equivalent to 0.2 mol % per mol of the silver halide, and after ripening was carried out for about 5 min, sodium thiosulfate, in an amount of $4.5\times10^{-6}$ mol/mol of Ag, potassium thiocyanate, in an amount of $2.0\times10^{-3}$ mol/mol of Ag, and N,N-dimethylselenourea, in an amount of $1\times10^{-6}$ mol/mol of Ag, were added to carry out optimum chemical sensitization.

Emulsion a7

Pure-silver-chloride cubic grains, the length of each side of which was 0.4 μm, were prepared in a known manner.

The emulsion was heated to 57° C., and then the below-mentioned sensitizing dyes ExS-4, ExS-5, and ExS-6 were added, in amounts of $3.0\times10^{-5}$ mol/mol of Ag, $2.1\times10^{-4}$ mol/mol of Ag, and $8.0\times10^{-4}$ mol/mol of Ag, respectively, and then AgBr fine grains having an average sphere-equivalent diameter of 0.05 μm were added, in an amount equivalent to 0.2 mol % per mol of the silver halide, and after ripening was carried out for about 5 min, sodium thiosulfate, in an amount of $4.5\times10^{-6}$ mol/mol of Ag, potassium thiocyanate, in an amount of $2.0\times10^{-3}$ mol/mol of Ag, and N,N-dimethylselenourea, in an amount of $1\times10^{-6}$ mol/mol of Ag, were added, to carry out optimum chemical sensitization.

Emulsion a8

Emulsion a8 was prepared in the same manner as in the emulsion a7, except that the added amounts of the sensitizing dyes ExS-1, ExS-2, and ExS-3 were changed to $6.9\times10^{-5}$ mol/mol of Ag, $1.8\times10^{-5}$ mol/mol of Ag, and $3.1\times10^{-4}$ mol/mol of Ag, respectively.

Emulsion a9

Pure-silver-chloride cubic grains, the length of each side of which was 0.7 μm, were prepared in a known manner.

The emulsion was heated to 57° C., and then the below-mentioned sensitizing dyes ExS-7 and ExS-8 were added in amounts of $4.3\times10^{-4}$ mol/mol of Ag and $4.3\times10^{-4}$ mol/mol of Ag, respectively, and then AgBr fine grains having an average sphere-equivalent diameter of 0.05 μm were added, in an amount equivalent to 0.2 mol % per mol of the silver halide, and after ripening was carried out for about 5 min, sodium thiosulfate, in an amount of $4.2\times10^{-6}$ mol/mol of Ag, potassium thiocyanate, in an amount of $1.6\times10^{-3}$ mol/mol of Ag, and N,N-dimethylselenourea, in an amount of $1\times10^{-6}$ mol/mol of Ag, were added, to carry out optimum chemical sensitization.

Using the emulsions al to a6 of the present invention and the emulsions a7 to a9, a multi-layered Sample 101 was made.

Sample 101

1) Support

The support that was used in this example was prepared as follows:

100 weight parts of polyethylene-2,6-naphthalate polymer, and 2 weight parts of Tinuvin P. 326 (trade name, manufactured by Ciba-Geigy Co.), as an ultraviolet absorbing agent, were dried, then melted at 300° C.; subsequently they were extruded through a T-type die, and stretched 3.3 times in the lengthwise direction at 140° C., and then 3.3 times in the width direction at 130° C.; and further they were thermally fixed for 6 seconds at 250° C., thereby PEN (polyethylene naphthalate) film having a thickness of 90 μm was obtained. To the PEN film, appropriate amounts of a blue dye, a magenta dye, and a yellow dye (I-1, I-4, I-6, I-24, I-26, I-27, II-5, as described in Kokai Giho: Kogi No. 94-6023) were added. Further, this film was wound around a stainless steel core (spool) having a diameter of 20 cm, and thermal history was imparted thereto at 110° C. for 48 hours, to obtain a support having suppressed core-set-curl.

2) Coating of a Subbing Layer

A coating solution for a subbing layer having the composition mentioned below was coated (10 ml/m$^2$, a bar coater was used) on each side of the above support, after both surfaces of the support were subjected to corona discharge, UV discharge, and glow discharge treatments. The thus-coated subbing layer was provided on the side that was heated at a higher temperature at the time of stretching. Drying was carried out at 115° C. for 6 minutes (the roller and the transportation apparatus in the drying zone all were set at 115° C.).

Composition of Coating Solution for the Subbing Layer:

| | |
|---|---|
| Gelatin | 0.1 g/m$^2$ |
| Sodium α-sulfo-di-2-ethylhexylsuccinate | 0.01 g/m$^2$ |
| Salicylic acid | 0.04 g/m$^2$ |
| p-Chlorophenol | 0.2 g/m$^2$ |
| $(CH_2{=}CHSO_2CH_2CH_2NHCO)_2CH_2$ | 0.012 g/m$^2$ |
| Polyamide-epichlorohydrin polycondensation product | 0.02 g/m$^2$ |

3) Coating of a Backing Layer

An antistatic layer, a magnetic recording layer, and a lubricant layer, each having the compositions mentioned below, were coated on the other side of the above support coated with the subbing layer, as a backing layer.

3-1) Coating of an Antistatic Layer

A layer having the following composition was coated:

| | |
|---|---|
| A dispersion of fine grain powder of a composite of stannic oxide-antimony oxide having an average grain size of 0.005 μm, and the specific resistance of 5 Ω•cm (secondary aggregation grain size about 0.08 μm) | 0.2 g/m$^2$ |
| Gelatin | 0.05 g/m$^2$ |
| $(CH_2{=}CHSO_2CH_2CH_2NHCO)_2CH_2$ | 0.02 g/m$^2$ |
| Polyoxyethylene-p-nonylphenol (polymerization degree: 10) | 0.005 g/m$^2$ |
| Resorsine | 0.22 g/m$^2$ |

3-2) Coating of a Magnetic Recording Layer

3-Poly(polymerization degree: 15)oxyethylene-propyloxytrimethoxysilan (15 weight %)-coated Co-γ-$Fe_2O_3$ (specific surface area, 43 m$^2$/g; major axis, 0.14 μm; minor axis, 0.03 μm; saturation magnetization, 89 emu/g, $Fe^{2+}/Fe^{3+}$=6/94; the surface was treated with 2 wt % based on $Fe_2O_3$, of aluminum oxide and silicon oxide, respectively; a dispersion of the iron oxide was carried out by an open kneader and a sand mill) (0.06 g/m$^2$), diacetylcellulose (1.2 g/m$^2$), and the hardener $C_2H_5C(CH_2OCONH{-}C_6H_3(CH_3)NCO)_3$ (0.3 g/m$^2$) were coated using acetone, methylethylketone, and cyclohexanone, as solvents, by means of a bar coater, to obtain a magnetic recording layer having a thickness of 1.2 μm. Silica grains (0.3 μm), as a matting agent, and 3-poly(polymerization degree: 15) oxyethylene-propyloxytrimethoxysilan (15 weight %)-coated aluminum oxide (0.15 μm), as an abrasive, were each added thereto, to give a coverage of 10 mg/m$^2$. Drying was conducted at 115° C. for 6 min (the roller and the transportation apparatus in the drying zone all were set at 115° C.). The increment of the color density of $D^B$ of the magnetic recording layer was about 0.1 when X-light (blue filter) was used. The saturation magnetization moment of the magnetic recording layer was 4.2 emu/g, the coercive force was $7.3\times10^4$ A/m, and the squareness ratio was 65%.

3-3) Preparation of a Lubricant Layer

A lubricant layer was prepared by coating the following composition so that the solid part of the coating amount became the following amount, and the layer was dried at 115° C. for 6 minutes, to prepare a lubricant layer (the roller and the transportation apparatus in the drying zone all were set at 115° C.).

| | |
|---|---|
| Diacetyl Cellulose | 25 mg/m$^2$ |
| $C_6H_{13}CH(OH)C_{10}H_{20}COOC_{40}H_{81}$ (Compound a)* | 6 mg/m$^2$ |
| $C_{50}H_{101}O(CH_2CH_2O)_{16}H$ (Compound b)* | 9 mg/m$^2$ |

*A mixture

The mixture of Compound a/Compound b (6/9) was dissolved in a solution of xylene and propyleneglycol monomethylether (1/1) at 105° C., and this solution was poured into a 10-fold volume of propyleneglycol monomethylether at room temperature and finely dispersed. This was further dispersed in acetone, and the obtained dispersion (average grain diameter: 0.01 μm) was added to the coating solution. Silica grains (0.3 μm), as a matting agent, and 3-poly (polymerization degree, 15) oxyethylene-propyloxytrimethoxysilan (15 weight %)-coated aluminum oxide (0.15 μm), as an abrasive, were each added thereto, to give a coverage of 15 mg/m$^2$. The lubricant layer showed excellent performances of the coefficient of dynamic friction: 0.06 (a stainless steel hard ball of 5 mmϕ, diameter, load: 100 g, speed: 6 cm/min), and of the static friction coefficient: 0.07 (clip method). The sliding property of the lubricant layer with the surface of the emulsion, which will be described below, was also excellent, such that the coefficient of dynamic friction was 0.12.

4) Coating of a Light-Sensitive Layer

Further, on the opposite side of the above backing layer, layers as described below were coated on the support, to obtain a color negative film, Sample 101. (Constitution of the light-sensitive layer)

Main materials used in each layer are classified as follows:

ExC: Cyan coupler

ExM: Magenta coupler

ExY: Yellow coupler

ExS: Sensitizing dye

UV: Ultraviolet ray absorbent

HBS: High-boiling organic solvent

H: Gelatin hardening agent (For specific compounds listed below, a number is given after its classification; chemical formulas are shown below.)

Figures corresponding to each component represents the coating amount in terms of g/m$^2$, and for silver halide in terms of silver. With respect to sensitizing dyes, the coating amount is shown in mol per mol of silver halide in the same layer.

| | | |
|---|---|---|
| First Layer (Halation-preventing layer) | | |
| Black colloidal silver | silver | 0.09 |
| Gelatin | | 1.60 |
| ExF-1 | | $2.0\times10^{-3}$ |
| Solid disperse dye ExF-2 | | 0.030 |
| Solid disperse dye ExF-3 | | 0.040 |

-continued

| | | |
|---|---|---|
| HBS-1 | | 0.15 |
| HBS-2 | | 0.02 |
| Second Layer (Intermediate layer) | | |
| 0.07 μm Silver bromide emulsion | silver | 0.065 |
| Polyethyl acrylate latex | | 0.20 |
| Gelatin | | 1.04 |
| Third Layer (Low sensitivity red-sensitive emulsion layer) | | |
| Emulsion a8 prepared in this Example | silver | 0.50 |
| ExC-1 | | 0.33 |
| Color-forming reducing agent I-7 | | 0.30 |
| Cpd-2 | | 0.025 |
| HBS-1 | | 0.10 |
| Gelatin | | 0.87 |
| Fourth Layer (Medium sensitivity red-sensitive emulsion layer) | | |
| Emulsion a5 of the present invention prepared in this Example | silver | 0.70 |
| ExC-1 | | 0.31 |
| Color forming reducing agent I-7 | | 0.023 |
| HBS-1 | | 0.10 |
| Gelatin | | 0.75 |
| Fifth Layer (High sensitivity red-sensitive emulsion layer) | | |
| Emulsion a2 of the present invention prepared in this Example | silver | 1.40 |
| ExC-1 | | 0.175 |
| Color-forming reducing agent I-7 | | 0.15 |
| Cpd-2 | | 0.050 |
| HBS-1 | | 0.22 |
| HBS-2 | | 0.050 |
| Gelatin | | 1.10 |
| Sixth Layer (Intermediate layer) | | |
| Cpd-1 | | 0.090 |
| Solid disperse dye ExF-4 | | 0.030 |
| HBS-1 | | 0.050 |
| Polyethyl acrylate latex | | 0.15 |
| Gelatin | | 1.10 |
| Seventh Layer (Low sensitivity green-sensitive emulsion layer) | | |
| Emulsion a7 prepared in this Example | silver | 0.35 |
| ExM-1 | | 0.41 |
| Color-forming reducing agent I-7 | | 0.30 |
| HBS-1 | | 0.30 |
| HBS-3 | | 0.010 |
| Gelatin | | 0.73 |
| Eighth Layer (Medium sensitivity green-sensitive emulsion layer) | | |
| Emulsion a4 of the present invention prepared in this Example | silver | 0.80 |
| ExM-1 | | 0.18 |
| Color-forming reducing agent I-7 | | 0.15 |
| HBS-1 | | 0.13 |
| HBS-3 | | $4.0\times10^{-3}$ |
| Gelatin | | 0.80 |
| Ninth Layer (High sensitivity green-sensitive emulsion layer) | | |
| Emulsion a1 of the present invention prepared in this Example | silver | 1.25 |
| ExM-1 | | 0.095 |
| Color-forming reducing agent I-7 | | 0.10 |
| Cpd-3 | | 0.040 |
| HBS-1 | | 0.25 |
| Polyethyl acrylate latex | | 0.15 |
| Gelatin | | 1.33 |
| Tenth Layer (Yellow filter layer) | | |
| Yellow colloidal silver | silver | 0.015 |
| Cpd-1 | | 0.16 |
| Solid disperse dye ExF-5 | | 0.060 |
| Solid disperse dye ExF-6 | | 0.060 |

-continued

| | | |
|---|---|---|
| Oil-soluble dye ExF-7 | | 0.010 |
| HBS-1 | | 0.60 |
| Gelatin | | 0.60 |
| Eleventh Layer (Low sensitivity blue-sensitive emulsion layer) | | |
| Emulsion a9 prepared in this Example | silver | 0.09 |
| Emulsion a6 of the present invention prepared in this Example | silver | 0.09 |
| ExC-1 | | $7.0 \times 10^{-3}$ |
| ExY-1 | | 0.79 |
| Color-forming reducing agent I-7 | | 0.70 |
| Cpd-2 | | 0.10 |
| Cpd-3 | | $4.0 \times 10^{-3}$ |
| HBS-1 | | 0.28 |
| Gelatin | | 1.20 |
| Twelfth Layer (High sensitivity blue-sensitive emulsion layer) | | |
| Emulsion a3 of the present invention prepared in this Example | silver | 1.00 |
| ExY-1 | | 0.22 |
| Color-forming reducing agent I-7 | | 0.20 |
| Cpd-2 | | 0.10 |
| Cpd-3 | | $1.0 \times 10^{-3}$ |
| HBS-1 | | 0.070 |
| Gelatin | | 0.70 |
| Thirteenth Layer (First protective layer) | | |
| UV-1 | | 0.19 |
| UV-2 | | 0.075 |
| UV-3 | | 0.065 |
| HBS-1 | | $5.0 \times 10^{-2}$ |
| HBS-4 | | $5.0 \times 10^{-2}$ |
| Gelatin | | 1.8 |
| Fourteenth Layer (Second protective layer) | | |
| 0.07 μm silver bromide emulsion | silver | 0.10 |
| H-1 | | 0.40 |
| B-1 (diameter: 1.7 μm) | | $5.0 \times 10^{-2}$ |
| B-2 (diameter: 1.7 μm) | | 0.15 |
| B-3 | | 0.05 |
| S-1 | | 0.20 |
| Gelatin | | 0.70 |

Further, in order to improve preservability, processability, pressure resistance, antimold and antibacterial properties, antistatic property, and coating property, compounds of W-1 or W-3, B-4 or B-6, and F-1 or F-17, and salts of iron, lead, gold, platinum, palladium, iridium, and rhodium were suitably added in each layer.

Then, emulsions b1 to b6 of Comparative Examples were prepared as follows.

Comparative emulsions b1 to b6 were prepared in the same manner as in the emulsions a1 to a6 of the present invention, except that, instead of solutions x-3 and x-4, x-5 solution (containing 17.2 g of NaCl in 100 ml) was used.

The average sphere-equivalent diameters, the average silver chloride contents, and the aspect ratios of the thus prepared comparative emulsions b1 to b6 are shown below:

| | Average sphere-equivalent diameter | Average silver chloride content | Aspect ratio |
|---|---|---|---|
| b1 (b2) | 0.86 μm | 99.5 | 6.1 |
| b3 | 1.24 μm | 99.7 | 7.0 |
| b4 (b5) | 0.58 μm | 99.4 | 5.5 |
| b6 | 0.82 μm | 99.5 | 6.1 |

Sample 102

Sample 102 was prepared in the same manner as in the Sample 101, except that the emulsions a1 to a6 of the present invention were changed to the emulsions b1 to b6.

Samples 103 and 104

Samples 103 and 104 were prepared in the same manner as in the Samples 101 or 102, with the following alteration, respectively.

In the third layer (low-sensitivity red-sensitive emulsion layer), ExC-6 was added, so that it would be 0.25 g/m$^2$.

In the fourth layer (medium-sensitivity red-sensitive emulsion layer), ExC-6 was added, so that it would be 0.13 g/m$^2$.

In the fifth layer (high-sensitivity red-sensitive emulsion layer), ExC-6 was added, so that it would be 0.25 g/m$^2$.

In the seventh layer (low-sensitivity green-sensitive emulsion layer), ExC-6 was added, so that it would be 0.20 g/m$^2$.

In the eighth layer (medium-sensitivity green-sensitive emulsion layer), ExC-6 was added, so that it would be 0.13 g/m$^2$.

In the ninth layer (high-sensitivity green-sensitive emulsion layer), ExC-6 was added, so that it would be 0.22 g/m$^2$.

In the eleventh layer (low-sensitivity blue-sensitive emulsion layer), ExC-6 was added, so that it would be 0.13 g/m$^2$.

In the twelfth layer (high-sensitivity blue-sensitive emulsion layer), ExC-6 was added, so that it would be 0.13 g/m$^2$.

Samples 105 and 106

Samples 105 and 106 were prepared in the same manner as in the Samples 103 or 104, with the following alteration, respectively.

A precursor ETA-49 of an auxiliary developing agent was added to the second, sixth, tenth, and thirteenth layers of Samples 103 and 104, in an amount of 1.5 mol per m$^2$.

ExS-1

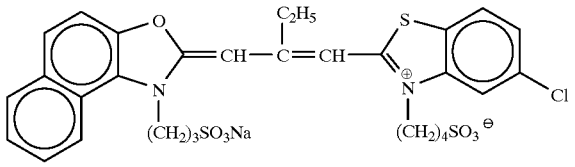

ExS-2

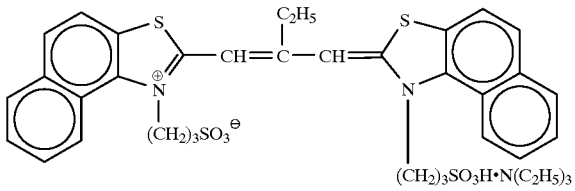

-continued
ExS-3
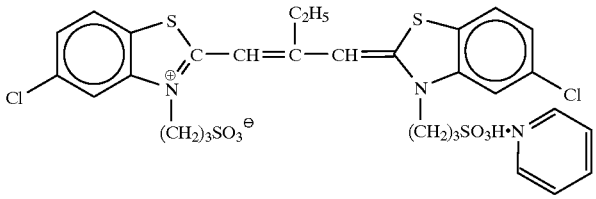
ExS-4
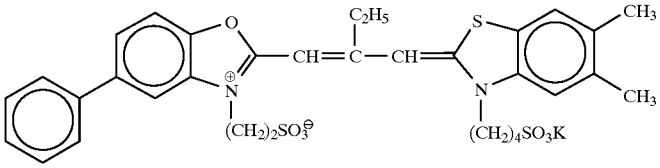
ExS-5
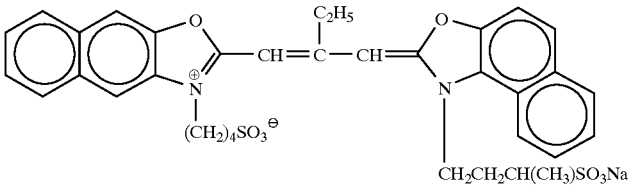
ExS-6
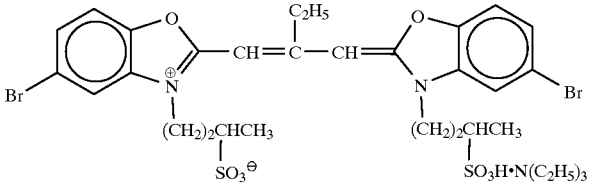
ExS-7
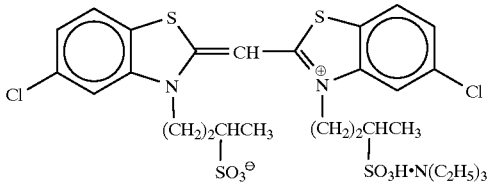
ExS-8
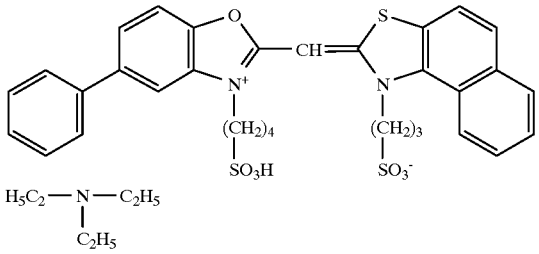
ExF-1
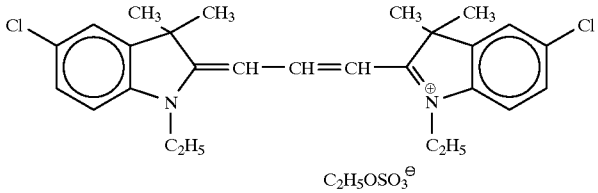

-continued
ExF-2
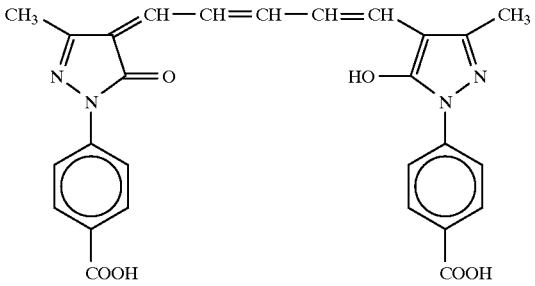
ExF-3
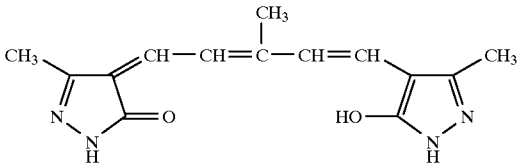
HBS-1
Tricresyl phosphate
HBS-2
Di-n-butylphthalate
HBS-3
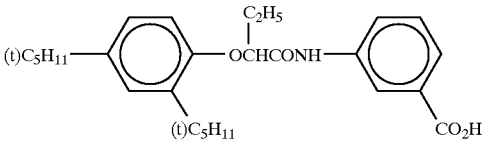
HBS-4
Tri(2-ethylhexyl) phosphate
(ExY-1)
Yellow coupler
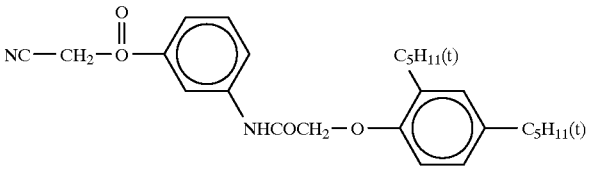
(ExM-1)
Magenta coupler
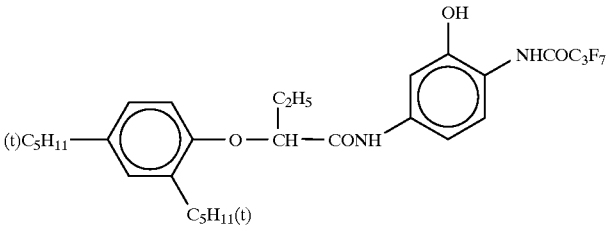
(ExC-1)
Cyan coupler
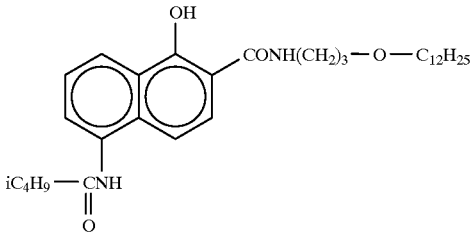

-continued
ExC-6
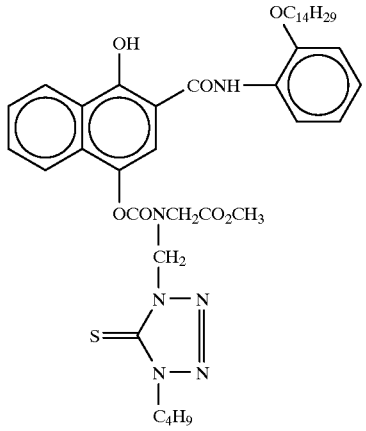
Cpd-1
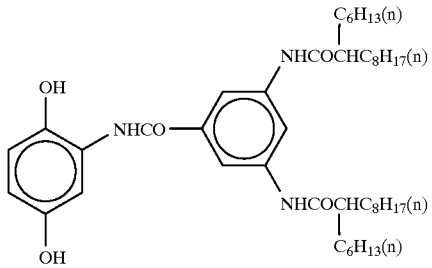
Cpd-2
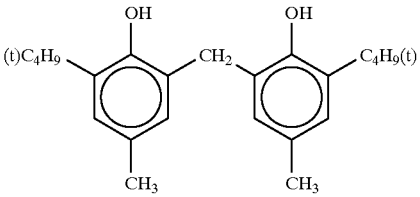
Cpd-3
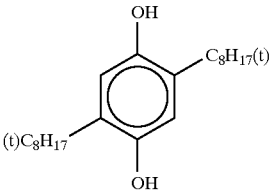
ExF-4
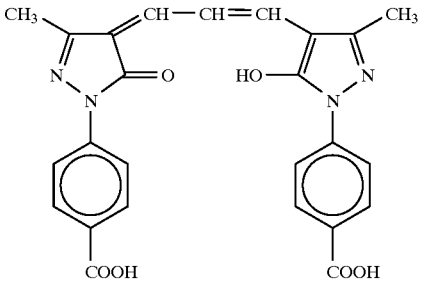

-continued
ExF-5
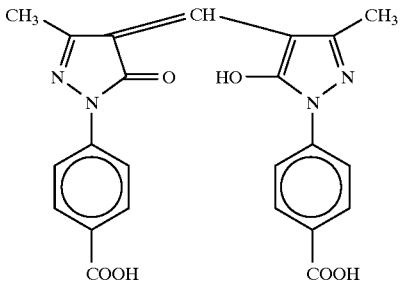
ExF-6
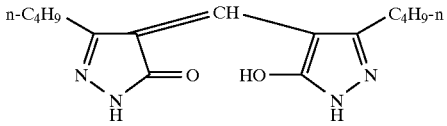
ExF-7
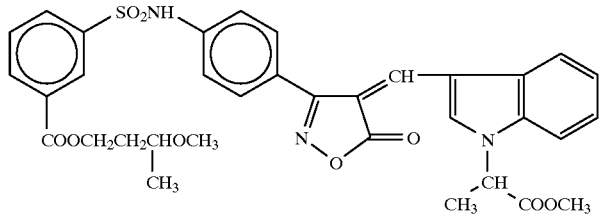
I-7
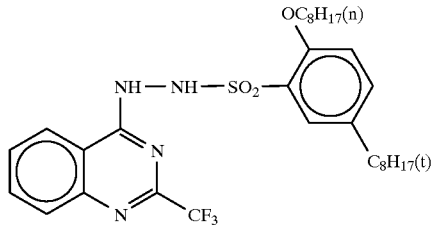
UV-1
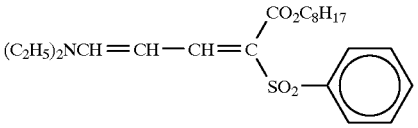
UV-2
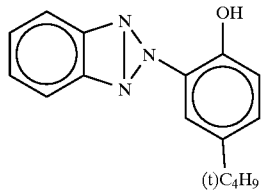
UV-3
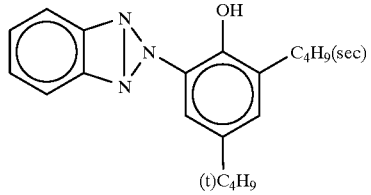
H-1
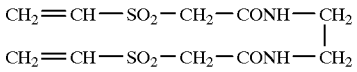

-continued
B-1
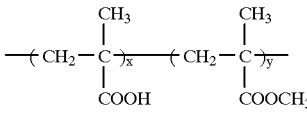
x/y = 10/90 (by weight ratio)
average molecular weight:
about 35,000
B-2
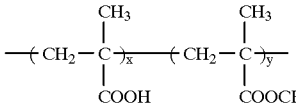
x/y = 40/60 (by weight ratio)
average molecular weight:
about 20,000
B-3
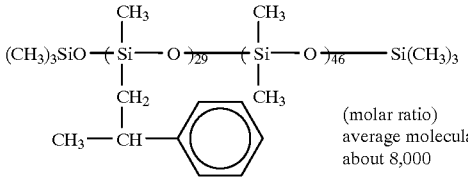
(molar ratio)
average molecular weight:
about 8,000
B-4
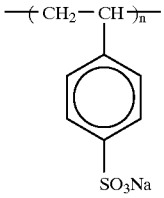
average molecular weight:
about 750,000
S-1
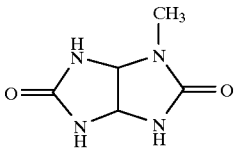
B-6
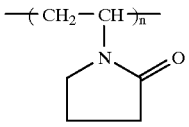
average molecular weight:
about 10,000
W-1
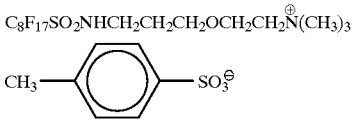
W-3
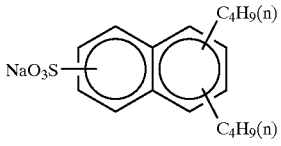
F-1
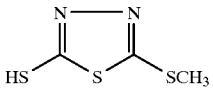
F-17
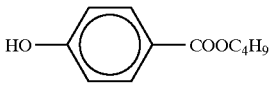
(ETA-49)

-continued

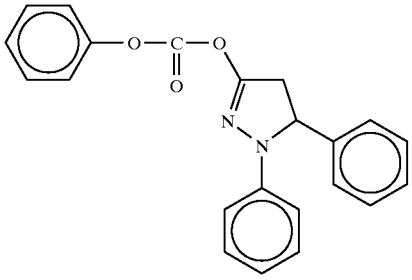

The thus prepared samples were stored for 16 hours at 40° C. and 70%, and then they were subjected to wedge exposure to light using an R filter, a G filter, and a B filter.

The thus exposed samples were processed continuously using the following processing steps and processing solution compositions, until the replenishment rate of the developer (developing solution) reached the volume of the tank.

| Processing step | Temperature | Replenisher* | Time | Tank volume (liter) |
|---|---|---|---|---|
| Development | 36° C. | 30 ml | 40 sec | 1.0 |
| Bleach-fix | 36° C. | 30 ml | 15 sec | 1.0 |
| Rinse (1) | 30° C. | — | 3 sec | 0.3 |
| Rinse (2) | 30° C. | — | 3 sec | 0.3 |
| Rinse (3) | 30° C. | — | 3 sec | 0.3 |
| Rinse (4) | 30° C. | — | 3 sec | 0.3 |
| Rinse (5) | 30° C. | 60 ml | 3 sec | 0.3 |
| Alkali processing | 30° C. | 30 ml | 5 sec | 0.3 |
| Drying | 80° C. | | 10 sec | |

*Replenishing amount per $m^2$ of the light-sensitive material
(Rinsing was conducted in a 5 tanks counter current system from (5) to (1).)

In the above processing, the water of Rinse (4) was pumped to a reverse osmosis membrane, and the passed water was supplied to Rinse (5), while the concentrated water not passed through the reverse osmosis membrane was returned to Rinse (4). To shorten the crossover time between the rinses, a blade was placed between the tanks, and the sample was passed between them.

Samples 101, 102, 103, and 104 were developed with Developer-1, and Samples 105 and 106 were developed with Developer-2 (alkali activating solution).

(Developer-1)

| | Tank solution | Replenisher |
|---|---|---|
| Water | 800 ml | 800 ml |
| Tripotassium phosphate | 30 g | 39 g |
| 5-Nitrobenzotriazole | 0.1 g | 0.25 g |
| Disodium N,N-bis(sulfonatoethyl)-hydroxylamine | 3.3 g | 6.6 g |
| Potassium chloride | 10 g | — |
| Hydroxyethyliden-1,1-diphosphonic acid (30% solution) | 4 ml | 4 ml |
| 1-Phenyl-4-methyl-4-hydroxymethyl-3-pyrazolidon | 1.5 g | — |
| Water to make | 1,000 ml | 1,000 ml |
| pH | 12 | |

(Developer-2 (Alkali activating solution))

Same solution as the above Developer-1 was used, except not to use the auxiliary developing agent (1-phenyl-4-methyl-4-hydroxymethyl-3-pyrazolidon).

(Bleach-fix Solution)

| | Tank Solution | Replenisher |
|---|---|---|
| Water | 600 ml | 150 ml |
| Ammonium thiosulfate (700 g/liter) | 100 ml | 250 ml |
| Ammonium sulfite monohydrate | 40 g | 40 g |
| Ethylenediaminetetraacetic acid iron (III) ammonium | 77 g | 154 g |
| Ethylenediaminetetraacetic acid | 5 g | 10 g |
| Ammonium bromide | 10 g | 20 g |
| Acetic acid (50%) | 70 ml | 140 ml |
| Water to make | 1,000 ml | 1,000 ml |
| (Rinse Solution) | | |
| Tap water | | |
| (Alkali Solution) | | |
| Pottasium carbonate | 30.0 g | |
| Water to make | 1,000 ml | |
| pH | 10.0 | |

Using an R filter, a G filter, and a B filter, the density was measured, to find the sensitivity and graininess, which values are shown in Table 3. The sensitivity is represented as the reciprocal of the exposure amount that gives the density of the fogging in the shape of the characteristic curve+0.1. The graininess is given as the RMS granularity of the part of the density of the fogging+0.3. They are given by the relative values by assuming the value obtained using Sample 101 with the color development time being 40 sec to be 100.

As is apparent from the results shown in Table 3, it can be understood that all of Samples 101, 103, and 105, in which the emulsion of the present invention was used, were apparently excellent in sensitivity and graininess in comparison with respective Comparative Samples 102, 104, and 106.

From the above, it is apparent that, in the light-sensitive material according to the present invention, excellent sensitivity and graininess can be attained by building a color-forming reducing agent, an auxiliary developing agent, and a DIR compound in the light-sensitive material.

TABLE 3

| | Sensitivety | | | Grainness | | |
|---|---|---|---|---|---|---|
| Sample No. | R | G | B | R | G | B |
| 101 (This invention) | 100 | 100 | 100 | 100 | 100 | 100 |
| 102 (Comparative Example) | 68 | 70 | 70 | 92 | 89 | 81 |
| 103 (This invention) | 69 | 80 | 80 | 88 | 80 | 68 |
| 104 (Comparative Example) | 42 | 45 | 42 | 70 | 72 | 72 |
| 105 (This invention) | 117 | 120 | 121 | 102 | 104 | 105 |
| 106 (Comparative Example) | 71 | 75 | 73 | 95 | 90 | 86 |

Having described our invention as related to the present embodiments, it is our intention that the invention not be limited by any of the details of the description, unless otherwise specified, but rather be construed broadly within its spirit and scope as set out in the accompanying claims.

What I claim is:

1. A silver halide photographic emulsion, which comprises silver halide tabular grains that have {100} planes as principal planes and have the following features after the emulsion is subjected to chemical sensitization:

(a) 50% or more of the projected areas of the tabular grains is attributed to tabular grains having an aspect ratio of 2 or more, (b) each of the tabular grains has a mixed crystal region in which the mixed crystal contains as halide ions, in addition to main halide ions, different halide ions in an amount of 0.01 mol % or more, but 25 mol % or less, in the nucleus part and/or in part of the grown part or in the whole of the grown part, and (c) when the principal planes of the tabular grains are observed using a transmission-type electron microscope, one or more, but ten or less, dislocation lines are observed on the principal planes of each grain of 50% or more of the tabular grains.

2. The silver halide photographic emulsion as claimed in claim 1, wherein the said main halide ions are chloride ions.

3. The silver halide photographic emulsion as claimed in claim 2, wherein the said different halide ions are bromide ions.

4. The silver halide photographic emulsion as claimed in claim 2, wherein the said different halide ions are iodide ions.

5. The silver halide photographic emulsion as claimed in claim 1, wherein the said main halide ions are bromide ions.

6. The silver halide photographic emulsion as claimed in claim 5, wherein the said different halide ions are chloride ions.

7. The silver halide photographic emulsion as claimed in claim 5, wherein the said different halide ions are iodide ions.

8. The silver halide photographic emulsion as claimed in claim 1, wherein, when the principal planes of the said tabular grains are observed using a transmission-type electron microscope, one end of a dislocation line is observed in each of two adjacent sides of the quadrangle that is the principal plane of each grain, in 40% or more of the tabular grains.

9. The silver halide photographic emulsion as claimed in claim 8, wherein, when the principal planes of the said tabular grains are observed using a transmission-type electron microscope, one or two dislocation lines, starting from one corner of the quadrangle that is the principal plane, are observed in 15% or more of the tabular grains.

10. The silver halide photographic emulsion as claimed in claim 8, wherein, when the principal planes of the said tabular grains are observed using a transmission-type electron microscope, one or two dislocation lines, not starting from any corner of the quadrangle that is the principal plane, are observed in 15% or more of the tabular grains.

11. The silver halide photographic emulsion as claimed in claim 1, wherein, when the principal planes of the said tabular grains are observed using a transmission-type electron microscope, one dislocation line, starting from one corner of the quadrangle that is the principal plane, is observed in 1% or more, but 40% or less, of the tabular grains.

12. The silver halide photographic emulsion as claimed in claim 1, wherein the deviation coefficient (standard deviation/average diameter) of the diameter distribution of the said tabular grains is from 0 to 0.35, and wherein the side ratio (the longer side of the quadrangle that is the principal plane/the shorter side) is from 1 to 2.

13. The silver halide photographic emulsion as claimed in claim 1, wherein 70% or more of the projected areas of the tabular grains is attributed to tabular grains having an aspect ratio of 2 or more.

14. The silver halide photographic emulsion as claimed in claim 1, wherein the aspect ratio of the tabular grains is 4 or more.

15. The silver halide photographic emulsion as claimed in claim 1, wherein 80% or more of the tabular grains has at least one dislocation line.

16. The silver halide photographic emulsion as claimed in claim 1, wherein the chemical sensitization is selected from the group consisting of sulfur sensitization, selenium sensitization, gold sensitization, palladium sensitization, noble-metal sensitization, and reduction sensitization.

17. A method for producing a silver halide photographic emulsion claimed in claim 2, comprising the steps of:

introducing silver ions and halide ions, as well as a dispersion medium, into a continuous double jet reaction vessel, forming nuclei of tabular grains in the presence of a bromide, together with a chloride that constitutes the main halide ions and is present in the dispersion medium, and further permitting 0.5 to 15 mol % of a bromide to be present in the reaction vessel during the growth of the grains.

18. A method for producing a silver halide photographic emulsion claimed in claim 2, comprising the steps of:

introducing silver ions and halide ions, as well as a dispersion medium, into a continuous double jet reaction vessel, forming nuclei of tabular grains in the presence of a bromide, together with a chloride that constitutes the main halide ions and is present in the dispersion medium, and further permitting 0.001 to 1 mol % of an iodide to be present in the reaction vessel during the growth of the grains.

19. A method for producing a silver halide photographic emulsion claimed in claim 2, comprising the steps of:

introducing silver ions and halide ions, as well as a dispersion medium, into a continuous double jet reaction vessel, and forming nuclei of tabular grains in the presence of 2.5 mol % or more of a bromide, together with a chloride that constitutes the main halide ions and is present in the dispersion medium.

20. The method for producing a silver halide photographic emulsion as claimed in claim 19, wherein the step of forming nuclei of tabular grains is carried out in the presence of 2.5 to 10 mol % of a bromide.

* * * * *